US007761023B2

(12) United States Patent
Sato

(10) Patent No.: US 7,761,023 B2
(45) Date of Patent: Jul. 20, 2010

(54) DEVELOPER CARTRIDGE, PROCESS UNIT, AND IMAGE FORMATION DEVICE

(75) Inventor: Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 642 days.

(21) Appl. No.: 11/564,642

(22) Filed: Nov. 29, 2006

(65) Prior Publication Data

US 2007/0122175 A1 May 31, 2007

(30) Foreign Application Priority Data

Nov. 30, 2005 (JP) ..... 2005-346130

(51) Int. Cl.
*G05G 15/00* (2006.01)
*G05G 15/08* (2006.01)

(52) U.S. Cl. ..... 399/90; 399/119

(58) Field of Classification Search ..... 399/90, 399/119, 107, 111
See application file for complete search history.

(56) References Cited

U.S. PATENT DOCUMENTS 5,923,926 A 7/1999 Isobe et al.
6,029,027 A 2/2000 Yokomori et al.
6,311,026 B1 * 10/2001 Higeta et al. ..... 399/111
6,782,219 B2 8/2004 Yoshino et al.
6,823,160 B2 11/2004 Okabe
6,934,485 B2 * 8/2005 Miyabe et al. ..... 399/90
6,952,543 B2 * 10/2005 Kusudo ..... 399/90
7,450,876 B2 * 11/2008 Ishii et al. ..... 399/90
2004/0005165 A1 * 1/2004 Yoon et al. ..... 399/90
2004/0009004 A1 * 1/2004 Mizoguchi ..... 399/90
2005/0053391 A1 * 3/2005 Ahn et al. ..... 399/90
2005/0201772 A1 * 9/2005 Ishii et al. ..... 399/90

FOREIGN PATENT DOCUMENTS

JP 2003287050 A * 10/2003
JP 2005258344 A * 9/2005

* cited by examiner

*Primary Examiner*—Susan S Lee
(74) *Attorney, Agent, or Firm*—Banner & Witcoff, Ltd.

(57) ABSTRACT

A developer cartridge is attachable to and detachable from an image forming unit. The developer cartridge includes a developer roller and an electrode member electrically connected to the developer roller. The electrode member faces in an attachment direction along which the developer cartridge is attached to the image forming unit. The electrode is configured to contact a power supply member disposed at the image forming unit.

13 Claims, 16 Drawing Sheets

DEVELOPER CARTRIDGE, PROCESS UNIT, AND IMAGE FORMATION DEVICE

CROSS REFERENCE TO RELATED APPLICATION

This application claims priority from Japanese Patent Application No. 2005-346130 filed in Japan on Nov. 30, 2005, which is incorporated by reference herein in its entirety.

TECHNICAL FIELD

Aspects of the disclosure relate to an image formation device, a developer cartridge, and a process unit to be provided in the image formation device.

BACKGROUND

There has been known an image formation device in which a photoconductive drum that forms electrostatic latent images is provided, and is removably attached from the device with a developer cartridge for supplying toner to the surface of the photoconductive drum.

The developer cartridge includes a box-shaped cabinet, and a developer roller that is supported by both side walls of the cabinet. From one of the side walls of the cabinet, a feed member protrudes to supply a bias to the developer roller. In the state that the developer cartridge is attached to the body of the image formation device, an electrode plate provided to the body comes in contact with the end surface of the feed member from the direction orthogonal to the attachment direction of the developer cartridge. From the electrode plate, the bias is applied to the developer roller via the feed member. Such a device is shown and described in JP-A-2003-295614. One potential problem with such a configuration is that, when the developer cartridge is attached to and detached from the body, the feed member may become damaged because the feed member slides in contact with the electrode plate.

SUMMARY

This summary is provided to introduce a selection of concepts in a simplified form that are further described below in the Detailed Description. This summary is not intended to identify key features or essential features of the claimed subject matter.

According to illustrative aspects of present invention, a developer cartridge is attachable to and detachable from an image forming unit. The developer cartridge includes a developer roller and an electrode member electrically connected to the developer roller. The electrode member faces in an attachment direction along which the developer cartridge is attached to the image forming unit. The electrode is configured to contact a power supply member disposed at the image forming unit.

According to other illustrative aspects of present invention, a process unit is attached to and detached from an image formation device. The process unit includes a drum unit supporting at least one of photosensitive drum, a developer cartridge attached to and detached from the drum unit, and a power supply member. The developer cartridge includes a developer roller supplying a developer to the photosensitive drum and an electrode member electrically connected to the developer roller. The electrode member faces in an attachment direction along which the developer cartridge is attached to the drum unit, and is configured to contact the power supply member.

According to other illustrative aspects of present invention, an image formation device includes a body, at least one of photosensitive drum supported at the body, a developer cartridge configured to be attached to and detached from the body, and a power supply member for supplying a bias to the electrode member. The developer cartridge includes a developer roller supplying developer to the photosensitive drum, and an electrode member electrically connected to the developer roller. The electrode member faces in an attachment direction along which the developer cartridge is attached to the body. The electrode member is configured to contact the power supply member disposed at the body.

According to other illustrative aspects of present invention, a developer cartridge includes a developer roller, a casing supporting rotatably the developer roller so that the developer roller is exposed to the outside, and an electrode member electrically connected to the developer roller. The electrode member is provided to extend toward a direction to which the developer roller exposes.

DETAILED DESCRIPTION

1. Entire Configuration

Figure 1:
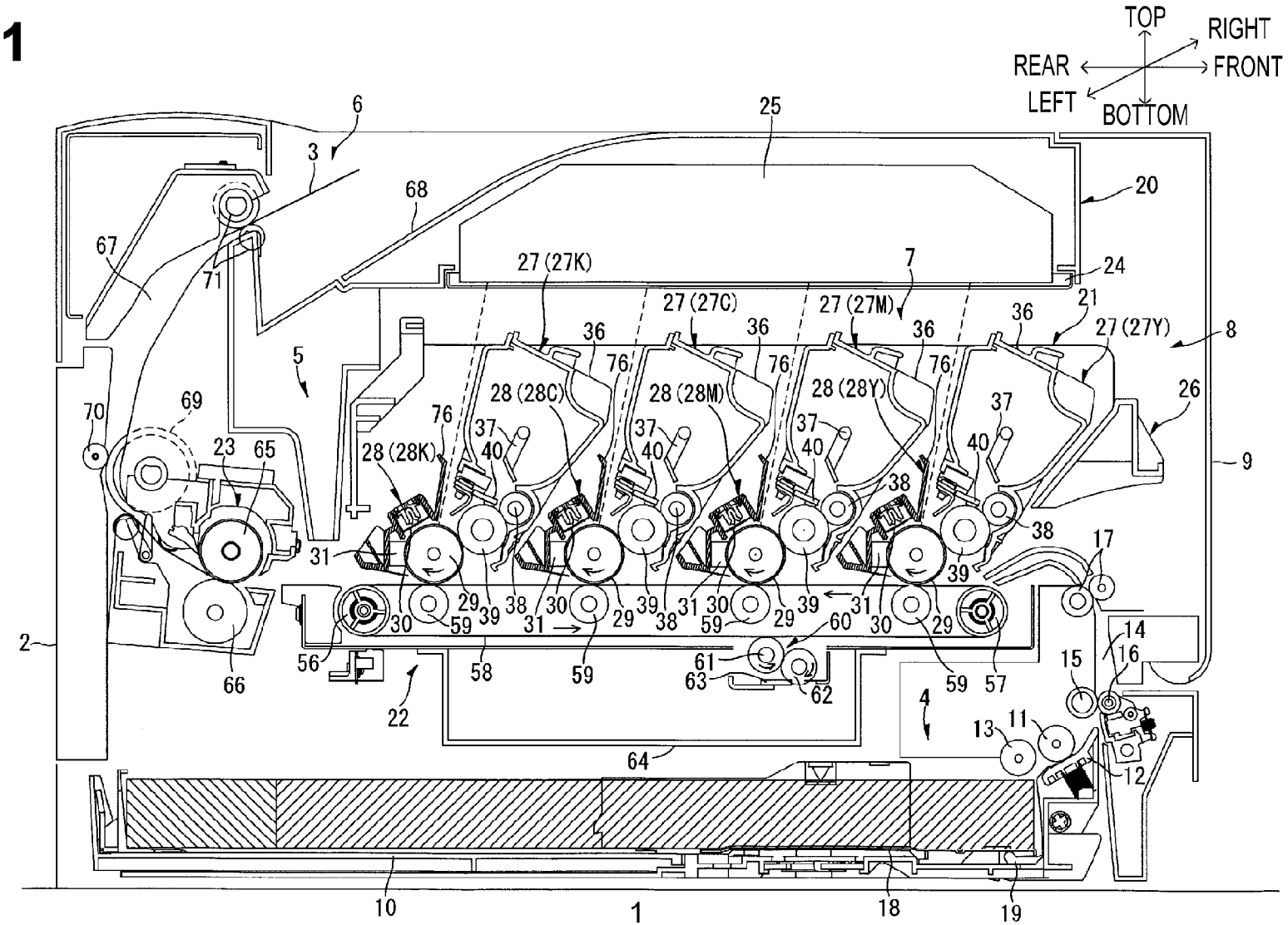
FIG. 1 is a cross sectional side view of an illustrative an image formation device according to aspects of the invention.

FIG. 1 is a cross sectional side view of an illustrative an image formation device according to aspects of the invention.

A color laser printer 1 is of a tandem type, including drum sub units 28 (will be described later) disposed in parallel in the horizontal direction. A body casing 2 includes therein a paper feed section 4, an image formation section 5, and a paper ejection section 6. The paper feed section 4 is provided for feeding paper 3, the image formation section 5 is for forming an image on fed paper 3, and the paper ejection section 6 is for ejecting the paper 3 formed with the image.

a. Body Casing

The body casing 2 is shaped substantially like a rectangular box when viewed from the side, and is formed with a drum housing space 7 therein to house a drum unit 26 that will be described later.

On one side surface of the body casing 2, an attachment/removal opening 8 is formed to communicate with the drum housing space 7. On the same side surface formed with the attachment/removal opening 8, a front cover 9 is provided to open/close the attachment/removal opening 8. When the front cover 9 is tilted toward the side of the body casing 2, the attachment/removal opening 8 is opened, and when the front cover 9 stands upright along the side surface of the body casing 2, the attachment/removal opening 8 is closed. As such, with the attachment/removal opening 8 left open, the drum unit 26 can be attached to and removed from the drum housing space 7 via the attachment/removal opening 8.

Note here that, in the description below, the side provided with the front cover 9, i.e., right side of FIG. 1, is referred to as front side, and the opposite side, i.e., the left side of FIG. 1, is referred to as rear side. The color laser printer 1 viewed from the front is used as a reference for right and left. As to the drum unit 26 and the developer cartridge 27, unless otherwise specified, the orientations, i.e., front, rear, right, and left, are defined in the state that those are attached to the body casing 2.

b. Paper Feed Section

The paper feed section 4 is provided at the bottom portion in the body casing 2. This paper feed section 4 includes a paper feed tray 10 for storing thereon stacks of the paper 3, a separation roller 11, a separation pad 12, a paper feed roller 13 provided on the rear side of the separation roller 11, and a paper conveying path 14 over which the paper 3 passes. The separation roller 11 and the separation pad 12 are so provided as to face each other above the front end portion of the paper feed tray 10.

The paper conveying path 14 is substantially U-shaped when viewed from the side. The upstream side end portion of the paper-conveying path 14 is adjacent to the separation roller 11, and the downstream side end portion thereof is adjacent from the front side to a conveying belt 58 that will be described later.

At some point of the paper conveying path 14, a paper dust removing roller 15 and a pinch roller 16 facing each other are provided above the front side of the separation roller 11. A pair of resist rollers 17 is also provided above the paper dust removing roller 15 and the pinch roller 16.

The paper feed tray 10 is formed therein with a paper pressboard 18, on which the paper 3 is disposed in layers. This paper pressboard 18 is swingably supported at its rear end portion so that the paper pressboard 18 is allowed to move freely between a placement position in which the front end portion is located at a lower portion along the bottom plate of the paper feed tray 10 and a paper-feed position in which the front end portion is located at an upper portion with some angle. The paper feed tray 10 is provided with a lever 19 at the lower front end portion to lift the front end portion of the paper pressboard 18. This lever 19 is supported at the lower front end portion of the paper pressboard 18 to freely move like a see-saw in the vertical direction.

When the lever 19 moves like a see-saw, the front end portion of the paper pressboard 18 is lifted by the lever 19, and the paper pressboard 18 is brought to the paper feed position.

When the paper pressboard 18 is brought to the paper feed position, the paper 3 at the top on the paper pressboard 18 is pressed by the paper feed roller 13. As the paper feed roller 13 rotates, the paper 3 is fed between the separation roller 11 and the separation pad 12.

Note here that when the paper feed tray 10 is removed from the body casing 2, the paper pressboard 18 comes at the placement position. When the paper pressboard 18 is located at the placement position as such, the paper 3 can be placed in layers on the paper pressboard 18.

Thus fed paper 3 is pinched between the separation roller 11 and the separation pad 12 as the separation roller 11 rotates, and is conveyed piece by piece. The paper 3 then passes through between the paper dust removing roller 15 and the pinch roller 16, and after any paper dust is removed, the paper is directed toward the resist rollers 17 along the paper conveying path 14.

The resist rollers 17 forward the paper 3 to the conveying belt 58.

c. Image Formation Section

The image formation section 5 includes a scanning section 20, a process section 21, an image transfer section 22, and a fixing section 23.

c-1. Scanner Section

The scanner section 20 is disposed above the body casing 2. The scanner section 20 is provided with a support board 24 that extends in directions of front, rear, right, and left, and a scanner unit 25 that is fixed to the upper surface of the support board 24. The scanner unit 25 carries therein optical members, e.g., four light sources, a polygon mirror, an fθ lens, a reflector mirror, a skew correction lens, and others. Laser beams coming from the light sources based on image data are deflected and scanned by the polygon mirror, and are passed through both the fθ lens and the skew correction lens. After being reflected by the reflector mirror, the light is irradiated onto the surfaces of photoconductive drums 29 provided for various colors (will be described later) by high speed scanning.

c-2. Process Section

The process section 21 is disposed below the scanner section 20 but above the paper feed section 4. The process section 21 includes the drum unit 26, and four developer cartridges 27 corresponding to four various colors.

c-2-1. Drum Unit

The drum unit 26 includes four drum sub units 28 for four various colors, i.e., the drum sub units 28 include a yellow drum sub unit 28Y, a magenta drum sub unit 28M, a cyan drum sub unit 28C, and a black drum sub unit 28K.

The drum sub units 28 are disposed in parallel at regular intervals in the front and rear direction. More specifically, from the front toward the rear, the yellow drum sub unit 28Y, the magenta drum sub unit 28M, the cyan drum sub unit 28C, and the black drum sub unit 28K are respectively disposed in a row.

As will be described later, the drum sub units 28 are each provided with a pair of side frames 75, and a center frame 76 that is disposed across between the pair of side frames 75 (refer to FIG. 3). Note that, in FIG. 1, the side frames 75 are schematically shown for the sake of brevity.

Figure 2:
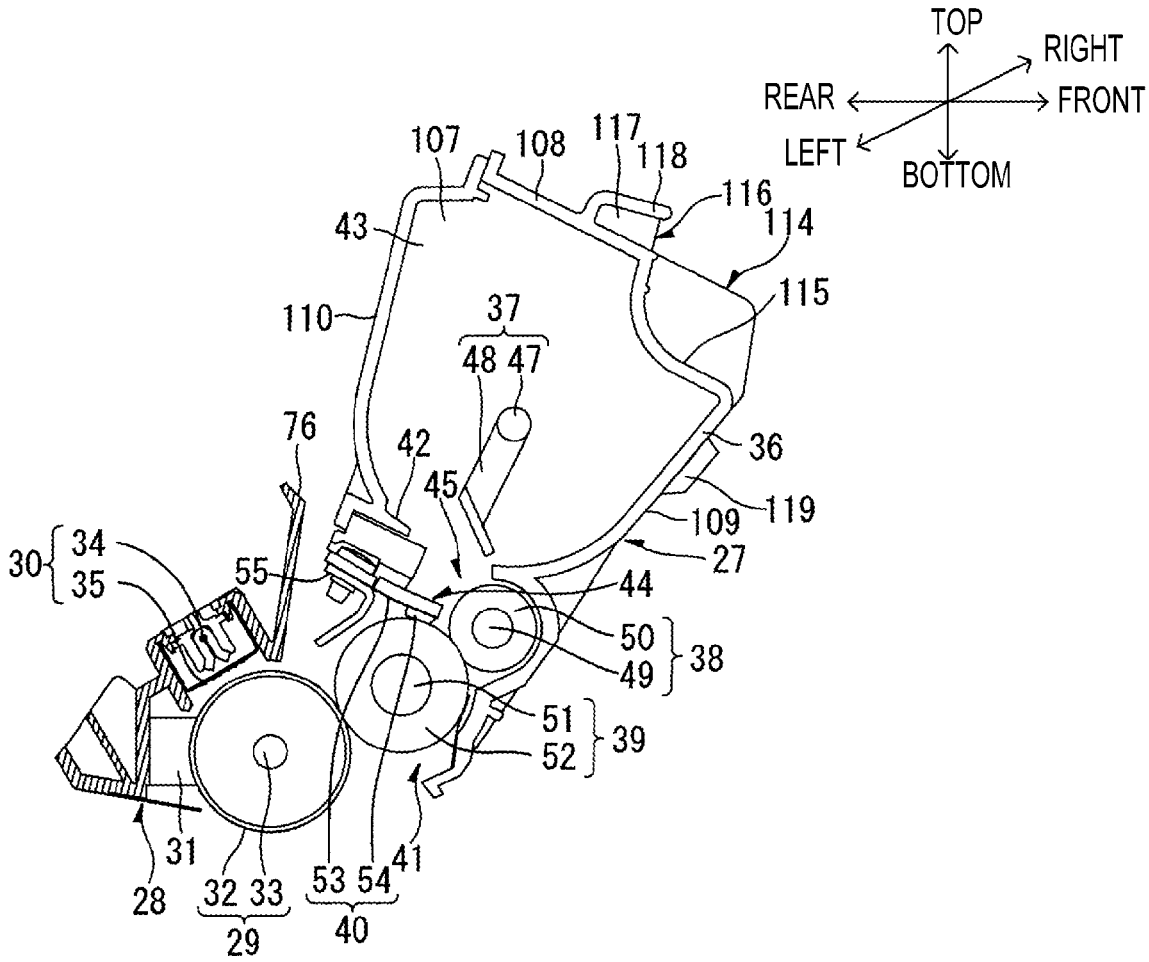
FIG. 2 is a cross sectional side view of a developer cartridge and a drum sub unit both shown in FIG. 1.

FIG. 2 is a cross sectional side view of the developer cartridge 27 and one of the drum sub units 28. The drum sub unit 28 shown in FIG. 2 is representative of the other drum sub-units 28 shown in FIG. 1.

As shown in FIG. 2, the drum sub unit 28 holds the photoconductive drum 29, a scorotron charger 30, and a cleaning brush 31.

The photoconductive drum 29 includes a drum body 32, and a drum shaft 33.

The drum body 32 is disposed along the lateral direction, and is shaped like a cylinder. The outermost layer of the drum body 32 is formed by a positively-charged photosensitive layer made of polycarbonate or others. The drum shaft 33 is disposed along the direction of an axis of the drum body 32. The drum body 32 is rotatably disposed around the drum shaft 33. Both end portions of the drum shaft 33 in the axial direction are inserted to the side frames 75 (refer to FIG. 3) to go therethrough, and are not rotatably supported by a side plate 74 (refer to FIG. 3). The side plate 74 will be described later. The photoconductive drum 29 is rotated, at the time of image formation, by a driving force coming from a motor (not shown) provided inside the body casing 2.

The scorotron charger 30 is disposed diagonally above the photoconductive drum 29 to face the photoconductive drum 29, and is supposed by the center frame 76. The scorotron charger 30 includes a discharge wire 34, and a grid 35. The discharge wire 34 is disposed to face the photoconductive drum 29, and the grid 35 is disposed between the discharge wire 34 and the photoconductive drum 29. At the time of image formation, a high voltage is applied to the discharge wire 34 so that corona discharge is generated in the discharge wire 34. At the same time, a voltage is applied to the grid 35, and the surface of the photoconductive drum 29 is uniformly charged positively while the amount of electric charge to be supplied to the photoconductive drum 29 is controlled.

The cleaning brush 31 is disposed so as to face and come in contact with the photoconductive drum 29 at the rear of the photoconductive drum 29, and is supported by the center frame 76. At the time of image formation, a cleaning bias is applied to the cleaning brush 31.

c-2-2. Developer Cartridge

As shown in FIG. 1, the developer cartridges 27 are each removably attached to the corresponding drum sub unit 28 of a predetermined color. That is, there are four developer cartridges 27, including a yellow developer cartridge 27Y that is removably attached to the yellow drum sub unit 28Y, a magenta developer cartridge 27M that is removably attached to the magenta drum sub unit 28M, a cyan developer cartridge 27C that is removably attached to the cyan drum sub unit 28C, and a black developer cartridge 27K that is removably attached to the black drum sub unit 28K.

As shown in FIG. 2, one of the developer cartridges 27 each include a developer frame 36, and components provided inside of the developer frame 36, i.e., an agitator 37, a supply roller 38, a developer roller 39, and a layer thickness restriction blade 40. The developer cartridge 27 shown in FIG. 2 is representative of the other developer cartridges 27 in FIG. 1.

The developer frame 36 is formed like a box in which an opening section 41 opens at the lower end portion, and a dividing wall 42 segments the developer frame 36 into a toner accommodating chamber 43 and a developing chamber 44. The dividing wall 42 is formed with a communicating opening 45 for communicating between the toner accommodating chamber 43 and the developing chamber 44.

The toner accommodating chamber 43 is filled with toner. More specifically, among the developer cartridges 27, the yellow developer cartridge 27Y is filled with yellow toner of yellow, the magenta developer cartridge 27M is filled with magenta toner, the cyan developer cartridge 27C is filled with cyan toner, and the black developer cartridge 27K is filled with black toner.

The toners of various colors are all polymerized, each being a positively-charged nonmagnetic single-component toner. The polymerized toner is of spherical form, and includes as a primary component a bonding resin that is obtained by copolymerizing a styrene monomer or an acrylic monomer by any known polymerization method such as suspension polymerization. The resulting polymerized toner is added with coloring agents of various colors, a charge control agent, a wax, and others, so that toner host particles are formed. For the aim of increasing the flowability, an external additive is also added.

The agitator 37 is provided inside of the toner accommodating section 43. The agitator 37 includes an agitator rotation shaft 47, and an agitating member 48. The agitator rotation shaft 47 is rotatably supported by both side walls 107 (will be described later) of the developer frame 36. The agitating member 48 is provided across in the axial direction of the agitator rotation shaft 47, and extends from the rotation shaft to the outside of the diameter direction. At the time of image formation, the agitator rotation shaft 47 receives the driving force coming from the motor (not shown) provided inside of the body casing 2, and the agitating member 48 moves circularly inside of the toner accommodating chamber 43.

In the developing chamber 44, the supply roller 38 is provided below the communicating opening 45. This supply roller 38 includes a supply roller shaft 49, and a sponge roller 50. The supply roller shaft 49 is made of a metal, and is rotatably supported by the both side walls 107 of the developer frame 36. The sponge roller 50 is made of a conductive sponge, covering around the supply roller shaft 49. At the time of image formation, the supply roller 38 is rotated in response to the driving force coming from the motor (not shown) provided inside of the body casing 2

In the developing chamber 44, the developer roller 39 is provided diagonally below the supply roller 38 toward the rear. This developer roller 39 includes a developer roller shaft 51, and a rubber roller 52. The developer roller shaft 51 is made of a metal, and is rotatably supported by the developer frame 36. The rubber roller 52 is made of a conductive rubber, covering around the developer roller shaft 51.

The developer roller 39 is arranged adjacent to the supply roller 38 such that the rubber roller 52 and the sponge roller 50 are brought into pressure contact with each other. The developer roller 39 is disposed so as to be exposed downward from the opening section 41 of the developing chamber 44.

At the time of image formation, the developer roller 39 is rotated in response to the driving force coming from the motor (not shown) provided inside of the body casing 2. To the developer roller 39, a developer bias is applied.

Inside of the developing chamber 44, the layer thickness restriction blade 40 is provided so as to come in contact with the developer roller 39 with pressure from above. The layer thickness restriction blade 40 includes a blade 53, and a press section 54. The blade 53 is made of a metal leaf spring member. The press section 54 has a semicircular cross section, and is made of an insulator silicone rubber. The press section 54 is provided at a free end of the blade 53.

The base end portion of the blade 53 is fixed to the dividing wall 42 by a fixing member 55, and with the elasticity of the blade 53, the press section 54 provided at the free end portion of the blade 53 is able to make contact with the rubber roller 52 of the developer roller 39 with pressure from above.

c-2-3. Developing Operation in Process Section

In the respective developer cartridges 27, the toner of a color filled in the toner accommodating chamber 43 is moved to the communicating opening 45 by gravity. The toner is then discharged from the communicating opening 45 toward the developing chamber 44 while being agitated by the agitator 37.

After being discharged from the communicating opening 45 to the developing chamber 44, the toner is supplied to the supply roller 38. The toner thus supplied to the supply roller 38 is supplied to the developer roller 39 by the rotation of the supply roller 38. At this time, the toner is positively charged by friction between the supply roller 38 and the developer roller 39 to which the developer bias is applied.

After being supplied to the developer roller 39, the toner is directed between the press section 54 of the layer thickness restriction blade 40 and the rubber roller 52 of the developer roller 39 by the rotation of the developer roller 39. The toner is then carried as a layer of a predetermined thickness on the surface of the rubber roller 52.

On the other hand, in the drum sub unit 28 provided to each of the developer cartridges 27, the scorotron charger 30 generates corona discharge so that the surface of the photoconductive drum 29 is uniformly positively charged.

After being uniformly positively charged by the scorotron charger 30, by the rotation of the photoconductive drum 29, the surface of the photoconductive drum 29 is exposed by high-speed scanning to laser beams coming from the scanner section 20, thereby forming an electrostatic latent image corresponding to an image to be formed on the paper 3.

When the photoconductive drum 29 rotates to a further degree, the positively-charged toner settled on the surface of the developer roller 39 is supplied by the rotation of the developer roller 39 to the electrostatic latent image formed on the surface of the photoconductive drum 29. In other words, the toner is supplied to a part of the surface of the photoconductive drum 29 that is exposed by the laser beams and thus becomes low in potential. Through such a toner supply, the electrostatic latent image on the photoconductive drum 29 becomes a visible image through developing, and a toner image of various colors is carried on the surface of the photoconductive drum 29.

Note that the toner left on the photoconductive drum 29 is collected by the developer roller 39 after the toner image is transferred to the paper 3 by the image transfer section 22. Also, any paper dust of the paper 3 attached on the photoconductive drum 29 is collected by the cleaning brush 31 after the toner image is transferred to the paper 3.

c-3. Image Transfer Section

As shown in FIG. 1, in the body casing 2, the image transfer section 22 is disposed above the paper feed section 4 but below the process section 21 along the front and rear direction. This image transfer section 22 includes a drive roller 56, a follower roller 57, the conveying belt 58, an image transfer roller 59, and a cleaning section 60.

The drive roller 56 and the follower roller 57 are disposed face to face with a space therebetween in the front and rear direction. The drive roller 56 is disposed at the rear of the black drum sub unit 28K, and the follower roller 57 is disposed at the front of the yellow drum sub unit 28Y.

The conveying belt 58 is a circular belt made of a resin film such as conductive polycarbonate or polyimide with conductive particles such as dispersed carbon. The conveying belt 58 is laid across the drive roller 56 and the follower roller 57.

At the time of image formation, the drive roller 56 is provided with the driving force coming from the motor (not shown) provided inside of the body casing 2, and the drive roller 56 is accordingly rotated. In response, the conveying belt 58 is moved circularly between the drive roller 56 and the follower roller 57 to rotate in the direction opposite to the photoconductive drum 29 at an image transfer position where the conveying belt 58 faces and comes in contact with the photoconductive drum 29 of the respective drum sub units 28. The follower roller 57 follows such a movement of the conveying belt 58.

The image transfer roller 59 is provided inside of the conveying belt 58, which is laid across the drive roller 56 and the follower roller 57. The image transfer roller 59 is disposed so as to face the corresponding photoconductive drum 29 with the conveying belt 58 sandwiched therebetween. The image transfer roller 59 includes a metal-made roller shaft, which is covered with a rubber roller made of a conductive rubber. The image transfer roller 59 is disposed at the image transfer position where it faces and makes contact with the conveying belt 58 so as to rotate together with the conveying belt 58. At the time of image formation, the image transfer roller 59 receives an image transfer bias from a high-voltage substrate (not shown) provided inside of the body casing 2.

The cleaning section 60 is disposed below the conveying belt 58, which is laid across the drive roller 56 and the follower roller 57. The cleaning section 60 includes a primary cleaning roller 61, a secondary cleaning roller 62, a scraping blade 63, and a toner reservoir section 64.

The primary cleaning roller 61 is disposed so as to come in contact with the lower conveying belt 58, which is located opposite to the upper conveying belt 58 to which the photoconductive drum 29 and the image transfer roller 59 abut. At the contact position, the primary cleaning roller 61 is disposed so as to be driven and rotated in the same direction as the rotating direction of the conveying belt 58. The primary cleaning roller 61 receives a primary cleaning bias at the time of image formation.

The secondary cleaning roller 62 is disposed so as to come in contact with the primary cleaning roller 61 from below. At the contact position, the secondary cleaning roller 62 is disposed so as to rotate in the direction opposite to the rotating direction of the primary cleaning roller 61. The second cleaning roller 62 receives a secondary cleaning bias at the time of image formation.

The scraping blade 63 is disposed so as to come in contact with the secondary cleaning roller 62 from below.

The toner reservoir section 64 is disposed below the primary and secondary cleaning rollers 61 and 62 to receive and store therein any toner dripping from the secondary cleaning roller 62.

The paper 3 coming from the paper feed section 4 is conveyed by the conveying belt 58, which is moved in response to the driving force from the drive roller 56 and the movement of the follower roller 57. The paper 3 is conveyed from the front toward the rear to sequentially pass over the image transfer positions for all of the drum sub units 28. During such image transfer, the toner images of various colors carried on the photoconductive drums 29 of the drum sub units 28 are sequentially transferred to the paper 3 so that a color image is formed on the paper 3.

That is, after a yellow toner image carried on the surface of the photoconductive drum 29 of the yellow drum sub unit 28Y is transferred to the paper 3, for example, a magenta toner image carried on the surface of the photoconductive drum 29 of the magenta drum sub unit 28M is overlaid on the paper 3 on the previously-transferred yellow toner image. Thereafter, similarly, cyan and black toner images follow an image overlay, i.e., a cyan toner image carried on the surface of the photoconductive drum 29 of the cyan drum sub unit 28C is transferred to the paper 3, and a black toner image carried on the surface of the photoconductive drum 29 of the black drum sub unit 28K. As such, the paper 3 is formed with a color image.

On the other hand, in the image transfer operation, any toner attached on the surface of the conveying belt 58 is, in the cleaning section 60, removed from the surface of the conveying belt 58 by the primary cleaning roller 61, the secondary cleaning roller 62, and the scraping roller 63.The toner removed by these rollers is received and stored in the toner reservoir section 64.

c-4. Fixing Section

The fixing section 23 is disposed to the rear of the black drum sub unit 28K in the body casing 2, and faces the image transfer position in the front and rear direction. The fixing section 23 includes a heat roller 65 and a press roller 66.

The heat roller 65 is made of a metallic tube with a mold release layer formed on the surface, and along the axial direction, a halogen lamp is equipped. By the halogen lamp, the surface of the heat roller 65 is heated to a fixing temperature.

The press roller 66 is disposed below the heat roller 65 to face the heat roller 65. The press roller 66 presses the heat roller 65 from below.

The color image as a result of image transfer on the paper 3 is forwarded to the fixing section 23. While the paper 3 passes through between the heat roller 65 and the press roller 66, the color image is thermally fixed to the paper 3. As such, the image formation is applied to the paper 3.

d. Paper Ejection Section

In the paper ejection section 6, a paper-ejection-side conveying path 67 for the paper 3 is substantially U-shaped when viewed from the side. An upstream side end portion of the paper-ejection-side conveying path 67 is adjacent to an area below the fixing section 23, and a downstream side end portion is adjacent above a paper ejection tray 68. The paper 3 is directed toward the rear side, and is ejected toward the front side after being reversed in orientation through the paper-ejection-side conveying path 67.

At some point along the paper-ejection-side conveying path 67, a conveying roller 69 and a pinch roller 70 are provided to face each other. At the downstream side end portion of the paper-ejection-side conveying path 67, a pair of paper ejection rollers 71 is provided.

The paper ejection section 6 is provided with a paper ejection tray 68. The paper ejection tray 68 is formed so as to accept thereon stacks of ejected paper 3. In the example shown, the paper ejection tray 68 includes an upper wall of the body casing 2 formed to be recessed by degrees from the front toward the rear.

The paper coming from the fixing section 23 is conveyed by the conveying roller 69 and the pinch roller 70 along the paper-ejection-side conveying path 67, and is ejected onto the paper ejection tray 68 by the paper ejection rollers 71.

2. Drum Unit

Figure 3:
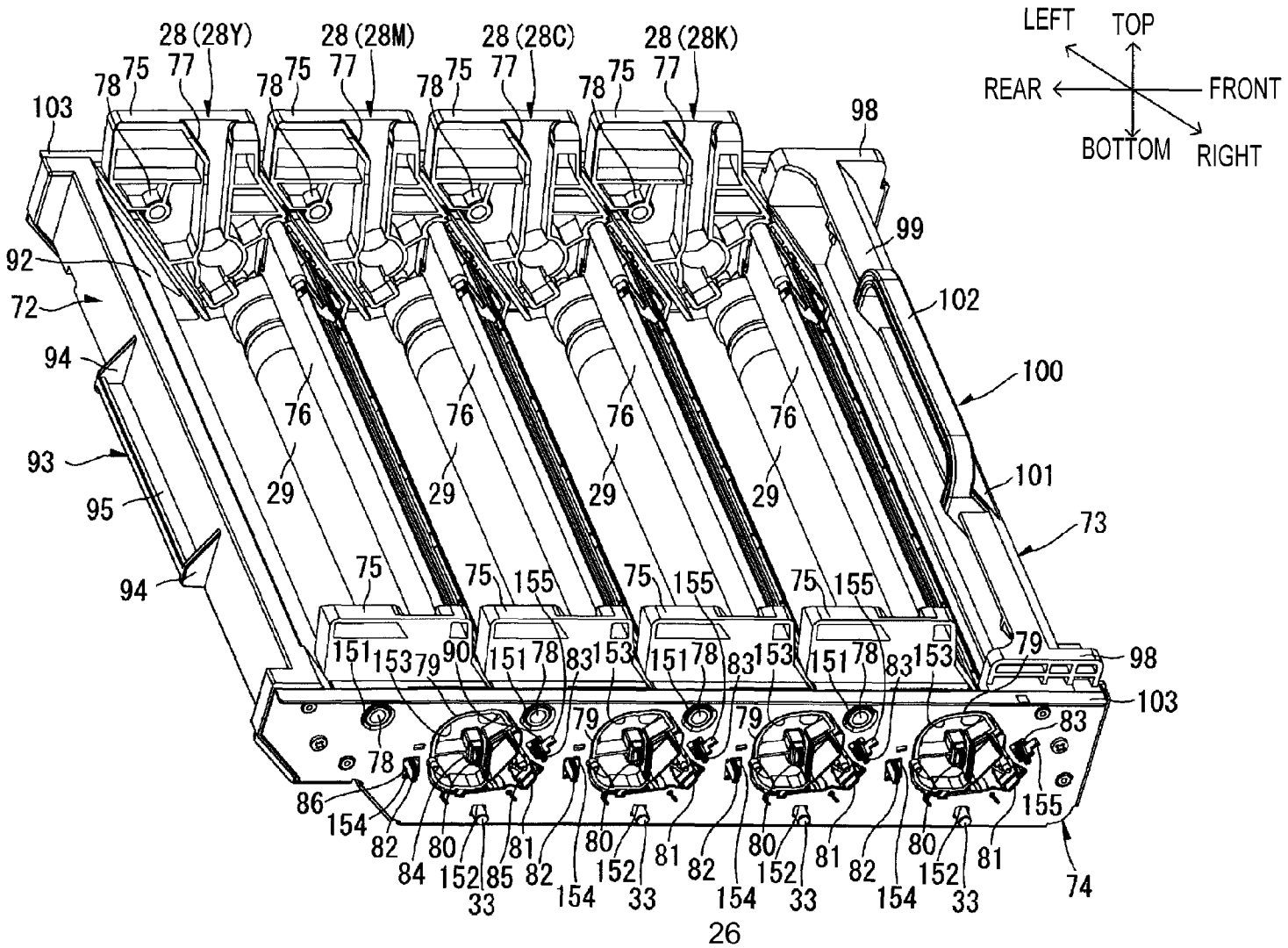
FIG. 3 is a right front perspective view of a drum unit (with no developer cartridge attached) of FIG. 1, viewed from above.
Figure 4:
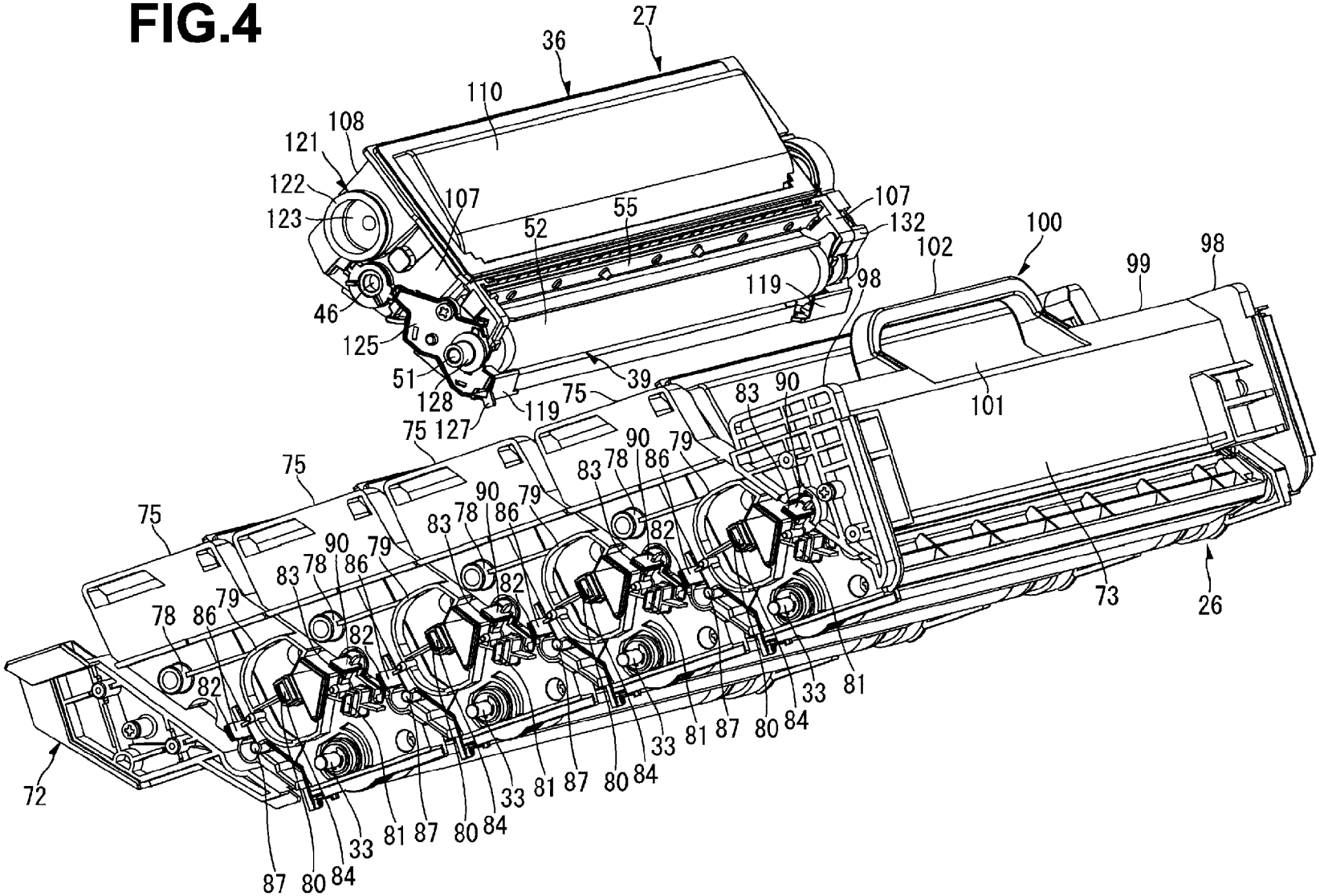
FIG. 4 is a right-side perspective view of the drum unit (with a developer cartridge removed) of FIG. 1, viewed from the rear.
Figure 5:
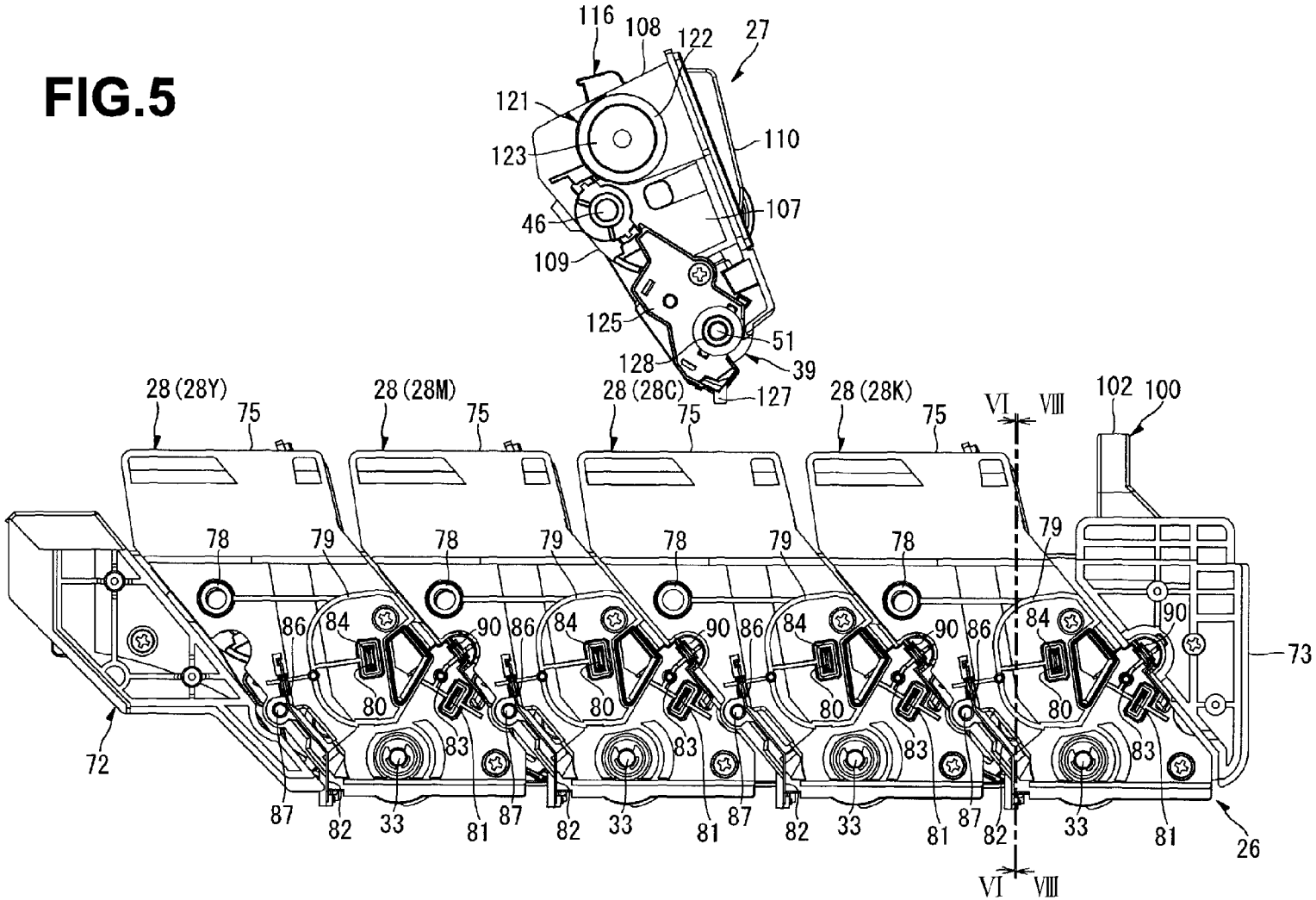
FIG. 5 is a right side view of the drum unit of FIG. 4.
Figure 6:
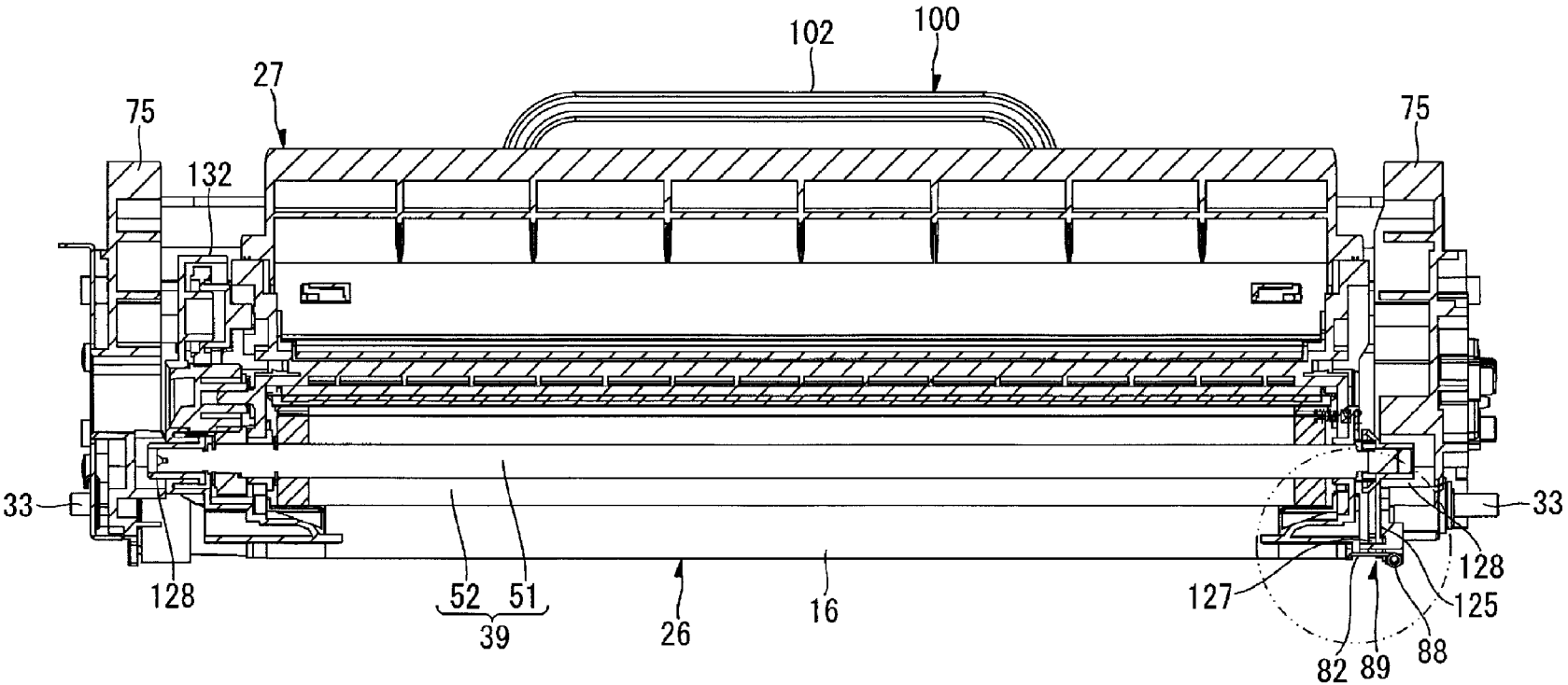
FIG. 6 is a cross sectional view of the drum unit along a line VI-VI of FIG. 5.
Figure 7:
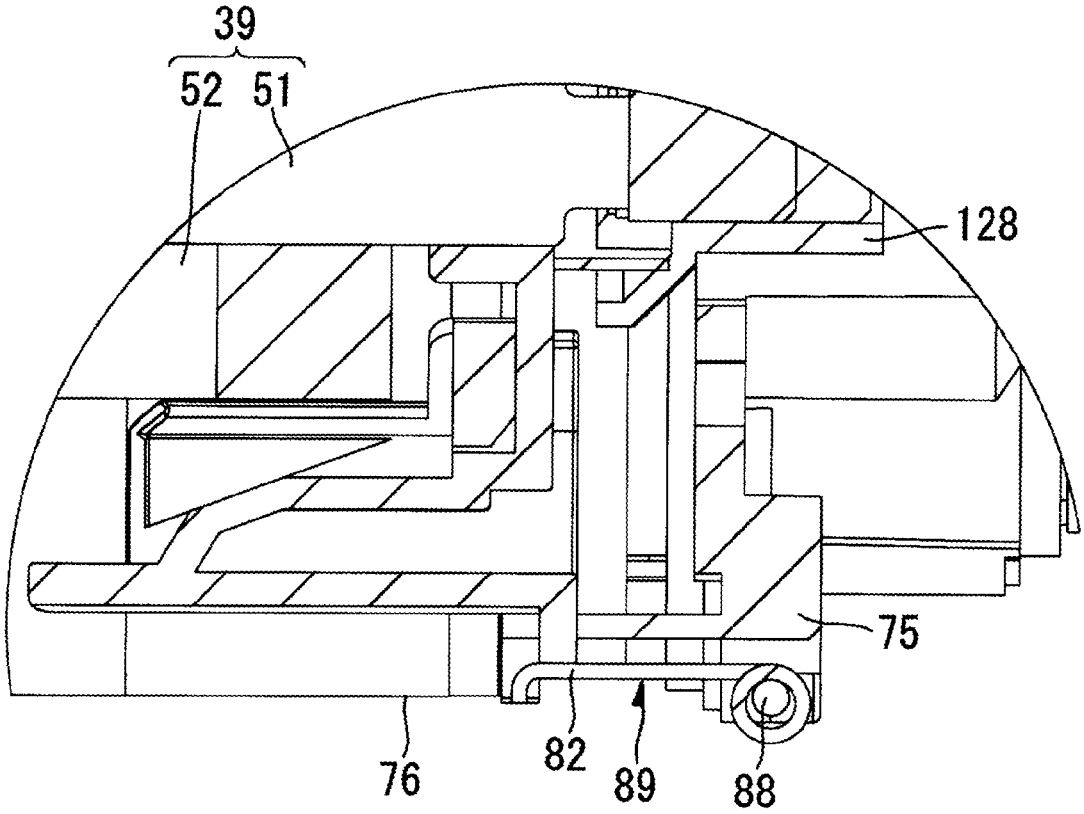
FIG. 7 is a detailed cross sectional view of the portion enclosed by a chain double-dashed line of FIG. 6.
Figure 8:
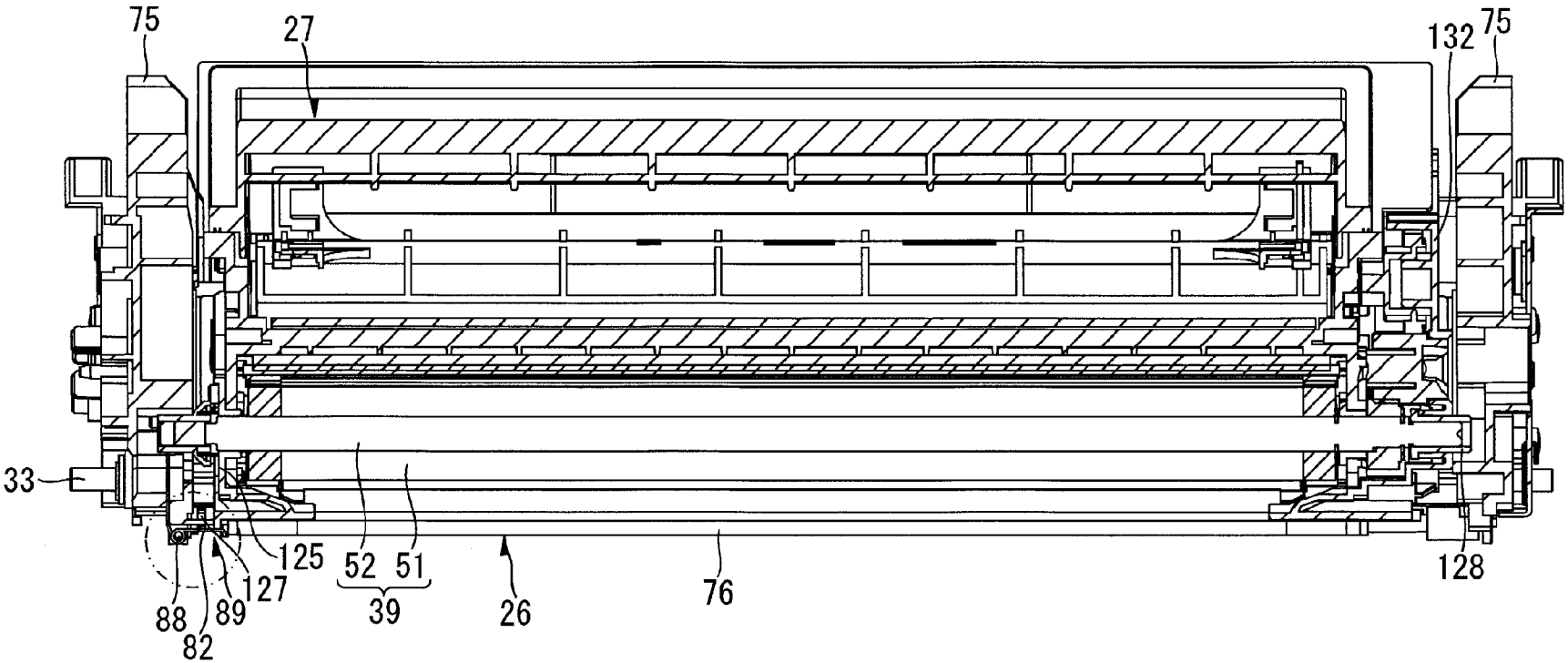
FIG. 8 is a cross sectional view of the drum unit along a line VIII-VIII of FIG. 5.
Figure 9:
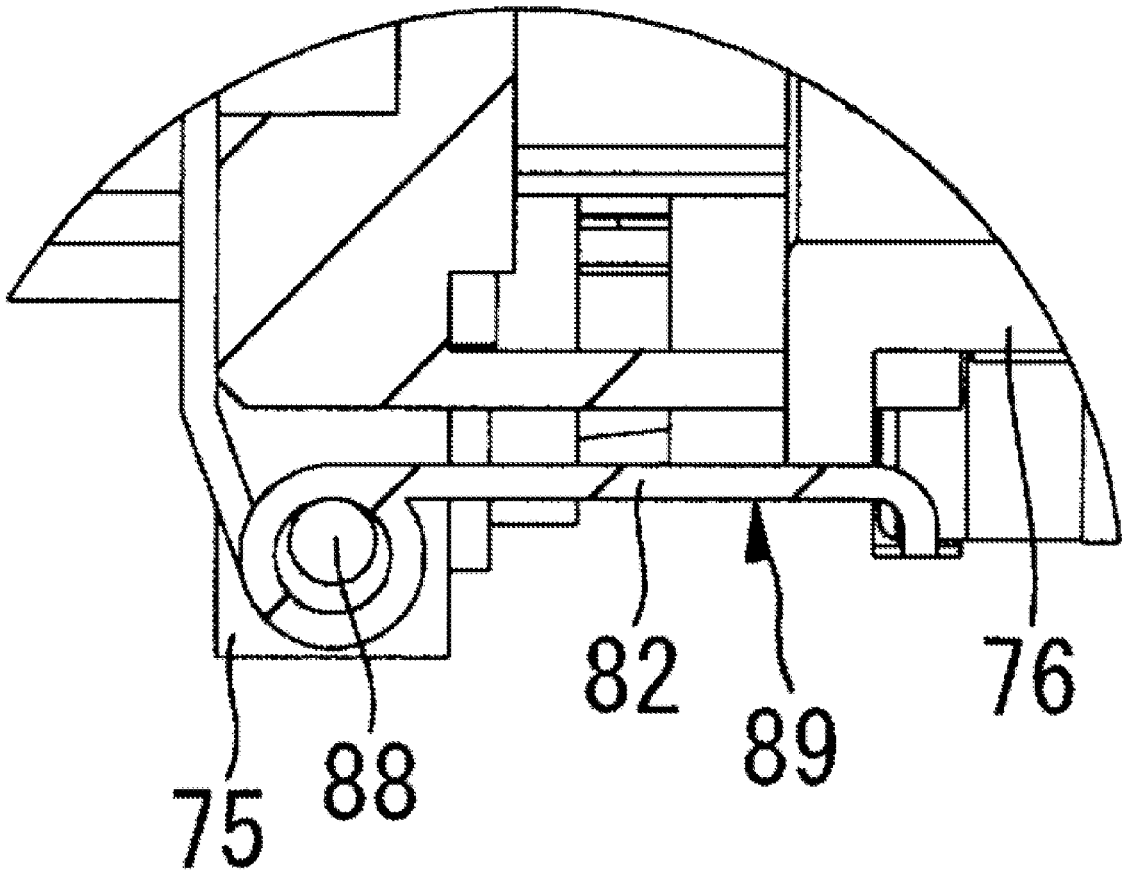
FIG. 9 is a detailed cross sectional view of the portion enclosed by a chain double-dashed line of FIG. 8.

FIG. 3 is a right front perspective view of the drum unit 26 (with no developer cartridge 27 attached), viewed from above. FIG. 4 is a right-side perspective view of the drum unit 26 (with one developer cartridge 27 removed), viewed from the rear, FIG. 5 is a right side view of the drum unit 26, FIG. 6 is a cross sectional view of the drum unit 26 along a line VI-VI of FIG. 5, FIG. 7 is a detailed cross sectional view of the portion enclosed by a chain double-dashed line of FIG. 6, FIG. 8 is a cross sectional view of the drum unit 26 along a line VIII-VIII of FIG. 5, and FIG. 9 is a detailed cross sectional view of the portion enclosed by a chain double-dashed line of FIG. 6. Note that, FIGS. 4, 5, 6, 8, 11, and 14 show a state in which the side plates 74 are removed.

The drum unit 26 includes four drum sub units 28 each for a predetermined color, a front beam 72, a rear beam 73, and a pair of side walls 74. The front and rear beams 72 and 73 are disposed on both sides, respectively, in the front rear direction of the four drum sub units 28 that are disposed in parallel in the front and rear direction. The pair of side walls 74 sandwich the components, i.e., the front beam 72, the four drum sub units 28, and the rear beam 73, from both sides in the width direction (right and left direction).

The drum unit 26 includes, as a piece, the four drum sub units 28, the front and rear beams 72 and 73, and the pair of side walls 74, which are removably attached to the drum housing space 7 in the body casing 2 to be able to freely slide.

a. Drum Sub Unit

The drum sub unit 28 includes a pair of side frames 75, and the center frame 76. The side frames 75 are disposed face to face with a space therebetween in the width direction. The center frame 76 is disposed across between the side frames 75.

a-1. Side Frame

The side frames 75 are each made of a resin material, and formed substantially like a rectangular plate when viewed from the side.

The side frames 75 are each formed with a guide groove 77 at inner wall surfaces facing each other in the width direction. The guide groove 77 is provided for guiding the developer cartridge 27 with respect to the corresponding drum sub unit 28.

The guide groove 77 is formed to be recessed from the inner wall surface of the side frame 75 toward the outside in the width direction. In the inner wall surface of the side frame 75, the guide groove 77 is formed in a substantially vertical direction from the upper rear end edge of the side frame 75 to the vicinity of the front lower end of the side frame 75. The lower end of the guide groove 77 is disposed at a position corresponding to the position of the developer roller shaft 51 where the developer roller 39 comes in contact with the photoconductive drum 29. The guide groove 77 accepts therein a collar member 128 of the developer cartridge 27 (will be described later) to be able to freely slide.

The side frames 75 are each formed with a boss 78 above the guide groove 77 toward the front. The boss 78 is formed like a cylinder protruding from the outer wall surface of the side frame 75 toward the outside in the width direction. The boss 78 is disposed so as to face a window 46 of the developer cartridge 27 in the width direction (will be described later) with the developer cartridge 27 attached to the drum sub unit 28.

a-1-1. Electrode

As shown in FIGS. 4 and 5, the side frame 75 on the right side is provided with a wire electrode 80, a grid electrode 81, a developer electrode 82, and a cleaning electrode 83. The wire electrode 80, the developer electrode 82, and the cleaning electrode 83 are formed by bending a wire, and the grid electrode 81 is formed by folding a sheet metal. These electrodes all abut a body-side electrode (not shown) in the state that the drum unit 26 is attached to the body casing 2. The body-side electrode is disposed on the right inner side surface of the body casing 2.

A wire electrode holding section 84 is formed almost at the center of the side frame 75 in the front and rear and up and down directions, and above the drum shaft 33 inserted through the side frame 75. The wire electrode holding section 84 protrudes outside (right side) in the width direction. The wire electrode 80 is routed to the wire electrode holding section 84, and forms a contact point with the body-side electrode on the tip end surface of the wire electrode holding section 84.

The grid electrode 81 is formed at a point on the rear end portion of the side frame 75 in the vertical direction, and diagonally above the drum shaft 33 toward the rear. The grid electrode 81 protrudes outside (right side) in the width direction, and forms a contact point with the body-side electrode on the tip end surface thereof.

A developer electrode holding section 86 is formed at some point of the front end portion of the side frame 75 in the vertical direction, and diagonally above the drum shaft 33 toward the front. The developer electrode holding section 86 protrudes outside (right side) in the width direction. The developer electrode 82 is routed to the developer electrode holding section 86, and forms a contact point with the body-side electrode on the tip end surface of the developer electrode holding section 86. Below the developer electrode holding section 86, a first latch boss 87 is formed protruding outside in the width direction from the side frame 75. The developer electrode 82 forms a loop along the circumferential surface of the first latch boss 87. The developer electrode 82 extends, diagonally below, from the first latch boss 87 toward the rear. The developer electrode 82 is then bent and extends downward, and is directed to the bottom surface of the side frame 75. As shown in FIGS. 6, 7, 8, and 9, the bottom surface of the side frame 75 is formed with a second latch boss 88, which extends in the front and rear direction. The developer electrode 82 routed to the bottom surface of the side frame 75 forms a loop along the circumferential surface of the second latch boss 88, and then extends toward the inner side (left side) in the width direction. The tip end of the developer electrode 82 reaches below the right end portion of the center frame 76. As such, the tip end portion of the developer electrode 82 is disposed in a space 89, which is formed across the side frame 75 and the center frame 76.

A cleaning electrode holding section 90 is formed at some point of the rear end portion of the side frame 75 in the vertical direction, above the grid electrode 81, and diagonally above the drum shaft 33 toward the rear. The cleaning electrode holding section 90 protrudes outside (right side) in the width direction. The cleaning electrode 83 is routed to the cleaning electrode holding section 90, and forms a contact point with the body-side electrode on the tip end surface of the cleaning electrode holding section 90.

On the outer wall surface of the right side frame 75, a circumferential mesh wall 79 is formed as a semicircle around the wire electrode 80, protruding outside in the width direction. There are four circumferential mesh walls 79 for the four wire electrodes 80.

a-2. Center Frame

Referring to FIG. 3, the center frame 76 is made of a resin material, and is formed separately from the side frames 75. The center frame 76 is shaped substantially like a slim plate when viewed from above, and the upper surface thereof is tilted from the front above toward the rear below. As described above, the center frame 76 holds the scorotron charger 30 and the cleaning brush 31 (refer to FIG. 2).

b. Front Beam

The front beam 72 is disposed on the front side of the four drum sub units 28, which are disposed in parallel in the front and rear direction. The front beam 72 is disposed across between a pair of side plates 74. The front beam 72 is configured as a piece using a resin material, and includes a front outer wall 91 and a front inner wall 92. The front outer wall 91 faces the outside of the drum unit 26, and the front inner wall 92 faces the inside of the drum unit 26.

The front outer wall 91 is shaped substantially like a slim rectangular plate when viewed from the front, extending in the width direction. The front outer wall 91 is disposed along the vertical direction, and is provided with a front grip section 93 at the center in the width direction. This front grip section 93 includes a pair of grip side plates 94, and a grip center plate 95. The grip side plates 94 are disposed face to face with a space therebetween in the width direction, and the grip center plate 95 is disposed across between such grip side plates 94.

The grip side plates 94 are each shaped substantially like a triangle plate when viewed from the side, protruding diagonally from the upper side toward the front below. The grip side plates 94 both protrude from the front wall surface of the front outer wall 91 toward the front.

The grip center plate 95 has an L-shaped cross section with the front end portion bent upward, and is provided across the lower end portions of the grip side plates 94.

The front inner wall 92 is shaped substantially like a slim rectangular plate when viewed from the rear, extending in the width direction. The front inner wall 92 is disposed at the rear of the front outer wall 91. This front inner wall 92 is tilted in the direction substantially parallel to the upper surface of the center frame 76.

c. Rear Beam

The rear beam 73 is disposed at the rear side of the four drum sub units 28, which are disposed in parallel in the front and rear direction. The rear beam 73 is disposed across between the pair of side plates 74. The rear beam 73 is configured as a piece using a resin material, and includes a pair of rear side walls 98, a rear link wall 99, and a rear grip section 100. The rear side walls 98 are disposed face to face in the width direction, and the rear link wall 99 is provided across the pair of rear side walls 98. The rear grip section 100 protrudes upward from the rear link wall 99.

The rear grip section 100 includes a grip concave section 101, and a rear handle 102. The grip concave section 101 is formed by the upper end portion of the rear link wall 99 being substantially recessed downward when viewed from the rear. The rear handle 102 is U-shaped when viewed from the rear, and is coupled to the upper end portion of the rear link wall 99 so as to be laid across the grip concave section 101 in the width direction.

d. Side Plate

The side plates 74 are provided in a pair to sandwich, from the sides in the width direction, the front beam 72, the four drum sub units 28, and the rear beam 73.

The side plates 74 are each made of a material having a linear expansion coefficient that is lower than a linear expansion coefficient of a resin material forming the drum sub units 28, e.g., a metal or a fiber reinforced resin, preferably a metal. The side plates 74 are each shaped substantially like a slim rectangular plate when viewed from the side, extending in the front and rear direction. With respect to the components disposed in parallel in the front and rear direction, i.e., the front beam 72, the four drum sub units 28, and the rear beam 73, the side plates 74 are each disposed so that the front end portion faces the front beam 72, and the rear end portion faces the rear beam 73.

The upper end portions of the side plates 74 are each formed with a collar section 103, which is bent outward in the width direction and extending outside in the width direction all the way to the front and rear direction. With such a collar section 103, the upper end portion of each of the side walls 74 is an L-shaped cross section. The collar section 103 is coupled to a rail (not shown) provided inside of the body casing 2 to be able to freely slide. When the drum unit 26 is attached/to detached from the body casing 2, the collar section 103 is guided to the rail, and the drum unit 26 is made to slide in the front and rear direction.

The side plates 74 are each formed with, at the upper end portion, four light pass through holes 151 to accept therein the bosses 78 of the drum sub units 28, respectively. These four light pass through holes 151 are formed at the upper end portion of the side plate 74 at regular intervals along the front and rear direction. The light pass through holes 151 are each circularly shaped to go through the thickness direction when the developer cartridge 27 is attached to the drum sub unit 28. The light pass through holes 151 are formed at positions where the windows 46 of the developer cartridges 27 face the bosses 78 in the width direction.

The side plates 74 are each formed with, at the lower end portion, four shaft holes 152 that are inserted to the end portion of the corresponding drum shaft 33 in the axial direction to go therethrough.

The right side plate 74 is formed with a center aperture section 153 to make the wire electrode 80 and the grid electrode 81, which are provided to each of the side frames 75 on the right side exposed outside in the width direction of the right side plate 74. There are four center aperture sections 153 formed at regular intervals in the front and rear direction. These center aperture sections 153 are relatively large to allow the coupling of the circumferential mesh wall 79 including the wire electrode 80, and allow the insertion of the grid electrode 81.

The right side plate 74 is also formed with a front-side aperture section 154 at the front of each of the center aperture sections 153. These front-side aperture sections 154 are provided to expose the contact point with the body-side electrode of the developer electrode 82 to the outside in the width direction of the right side plate 74.

The right side plate 74 is also formed with a rear-side aperture section 155 at the rear of each of the center aperture sections 153. These rear-side aperture sections 155 are provided to expose the contact point with the body-side electrode of the cleaning electrode 83 to the outside in the width direction of the right side plate 74 in the state that the side plates 74 are each attached to the drum sub units 28.

3. Developer Cartridge

Figure 10:
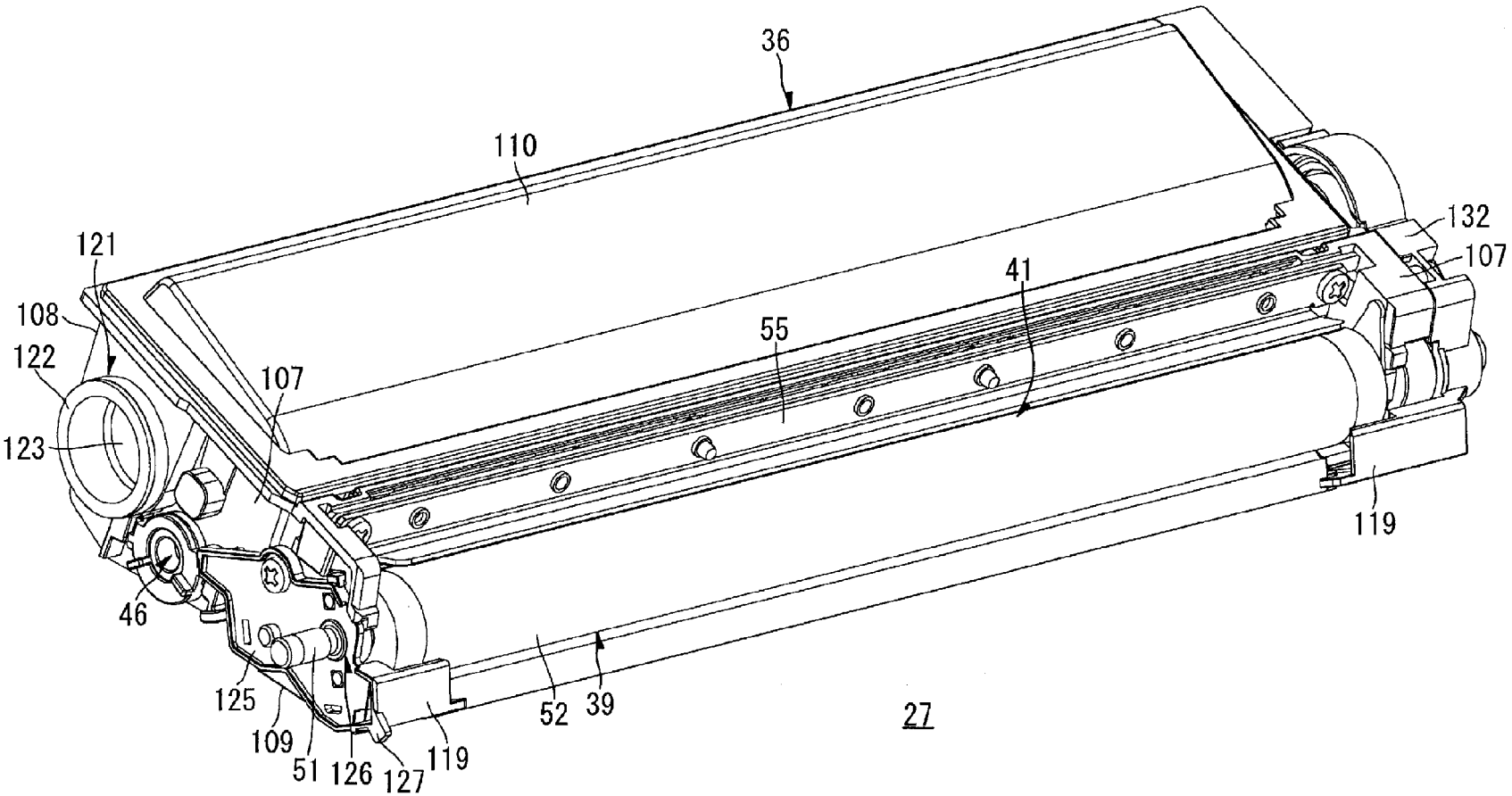
FIG. 10 is a right rear perspective view of the developer cartridge (with a collar member removed) of FIG. 1, viewed from below.

FIG. 10 is a right rear perspective view of the developer cartridge 27 viewed from below.

a. Developer Frame

As shown in FIG. 10, the developer frame 36 of the developer cartridge 27 includes, as a piece, a pair of side walls 107, an upper wall 108, a front wall 109, and a rear wall 1 10. The side walls 107 are disposed face to face in the width direction. The upper wall 108 is disposed across between the upper end edges of the side walls 107, and the front wall 109 is disposed across between the upper end edges of the side walls 107. The rear wall 110 is disposed across between the rear end edges of the side walls 107. The developer frame 36 is formed with, at its lower end portion, an opening section 41 by the side walls 107 and the lower end edges of the front and rear walls 109 and 110 to expose the developer roller 39.

b. Side Wall

As shown in FIGS. 4, 5, and 10, the side walls 107 are each formed with the window 46 for use to detect the remaining amount of toner filled in the toner accommodating chamber 43. The window 46 is embedded at the position slightly above the center of the side wall 107 in the vertical direction, and closer to the side of the front wall 109. These windows 46 are disposed to face each other with the toner accommodating chamber 43 therebetween, and light for use to detect the remaining amount of toner is passed therethrough along the width direction.

The right side wall 107 is formed with, at the portion above the window 46, a toner filling opening 121 to fill the toner accommodating chamber 43 with a toner. The toner filling opening 121 is provided with a filling opening wall section 122, which is shaped like a cylinder protruding from the side wall 107. The toner filing opening 121 is closed by a cap 123 coupled to the toner filling opening wall section 122.

The right side wall 107 is also formed with, at the lower end portion, a bearing member 125 that supports the shaft end portion of the developer roller shaft 51 to be able to freely rotate. The shaft end portion of the developer roller shaft 51 protrudes, on the right side, from the bearing member 125. As shown in FIGS. 4 and 5, the right side of the shaft end portion of the developer roller shaft 51 is covered from the outside by the collar member 128 serving as a substantially-cylindrical protection section.

Note that FIG. 10 is showing the state in which the collar member 128 is removed.

The bearing member 125 is made of a plate-like conductive resin, and as shown in FIG. 10, is formed with a bearing hole 126 at the lower end portion. Through the bearing hole 126, the shaft end portion of the developer roller shaft 51 is inserted.

The bearing member 125 is formed with, as a piece, an electrode member 127 at the lowermost end portion. The electrode member 127 receives a developer bias for application to the developer roller shaft 51 from the developer electrode 82 provided to the drum unit 26. The electrode member 127 is formed like a thin rectangular plate in the width direction, protruding downward from the lowermost end portion of the bearing member 125.

As shown in FIGS. 6 and 8, the left shaft end portion of the developer roller shaft 51 protrudes from the left side wall 107. Thus protruding shaft end portion is covered from the outside by the collar member 128 shaped substantially like a cylinder.

Although not shown, the left side wall 107 is provided with a gear mechanism for transmitting a driving force to the agitator 37, the supply roller 38, and the developer roller 39. The driving force comes from the motor (not shown) that is provided inside of the body casing 2 when the drum unit 26 is attached to the body casing 2 together with the developer cartridge 27. As shown in FIG. 10, the left side wall 107 is attached with a gear cover 132 for covering the gear mechanism.

3. Upper Wall

As shown in FIGS. 2 and 5, the upper wall 108 is provided with a developer cartridge grip section 114. The developer cartridge grip section 114 is provided at the center of the upper wall 108 of the developer frame 36 in the width direction, and as shown in FIG. 2, includes a concave section 115 and a handle 116. The concave section 115 is formed by the upper wall 108 of the developer frame 36 being recessed downward, and the handle 116 is provided at the rear end portion of the concave section 115.

The concave section 115 is shaped substantially like a rectangular recess when viewed from above, and the front end portion is notched to open toward the front.

The handle 116 is disposed so as to extend in the width direction at the rear end portion of the concave section 115. This handle 116 includes grip-side walls 117, and a grip center wall 118. The grip-side walls 117 serve to sandwich the concave section 115 in the width direction, and the grip center wall 118 is disposed across between the grip side walls 117.

The grip side wall 117 is shaped like a triangle when viewed from the side, being reduced in width toward the rear. The grip side wall 117 is formed so as to extend upward from the both end portions of the concave section 115 in the width direction. The grip center wall 118 is disposed across between the upper end edges of the grip side wall 117.

As such, a user can pull out the developer cartridge 27 in the upward direction by the developer cartridge grip section 114.

4. Front Wall

As shown in FIG. 10, the lower end portion of the front wall 109 is provided with, at each end portion in the width direction, a side end front wall 119 to be a piece with the bearing member 125 and the gear cover 132. The side end front wall 119 is formed so as to extend downward and bend rearward, i.e., has the substantially L-shaped cross section.

5. Rear Wall

As shown in FIG. 2, at the lower end portion of the rear wall 110, the dividing wall 42 is formed so as to be orthogonal to the lower end edge of the rear wall 110, and extend along the lower end edge thereof. As shown in FIGS. 2 and 10, the dividing wall 42 is attached with the fixing member 55 having the substantially L-shaped cross section. There is a base end portion of the blade 53 of the layer thickness restriction blade 40 between the fixing member 55 and the dividing wall 42.

4. Attachment of Developer Cartridge to Drum Unit

Figure 11:
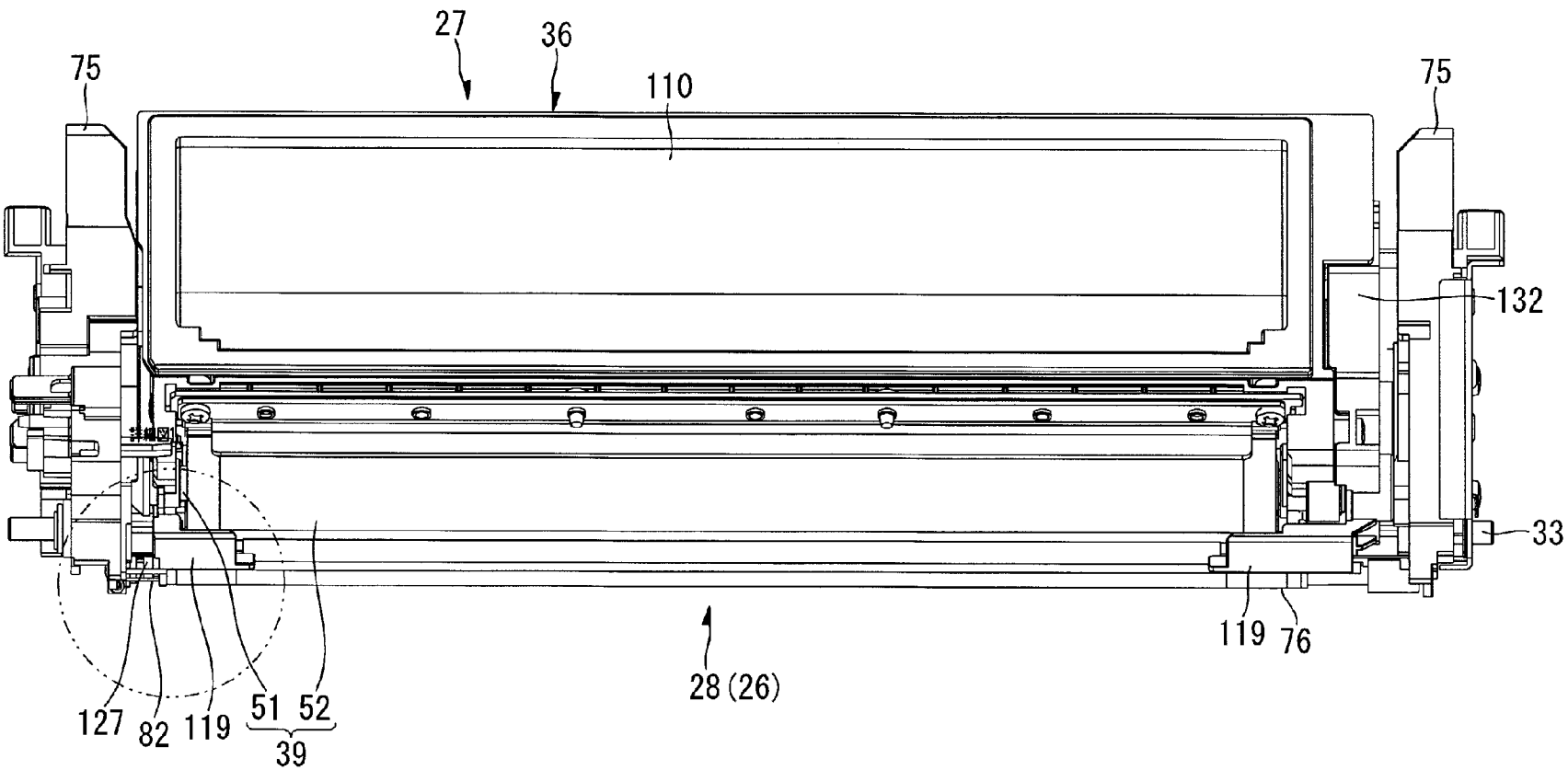
FIG. 11 is a rear side view of a drum sub unit attached with the developer cartridge of FIG. 10.
Figure 12:
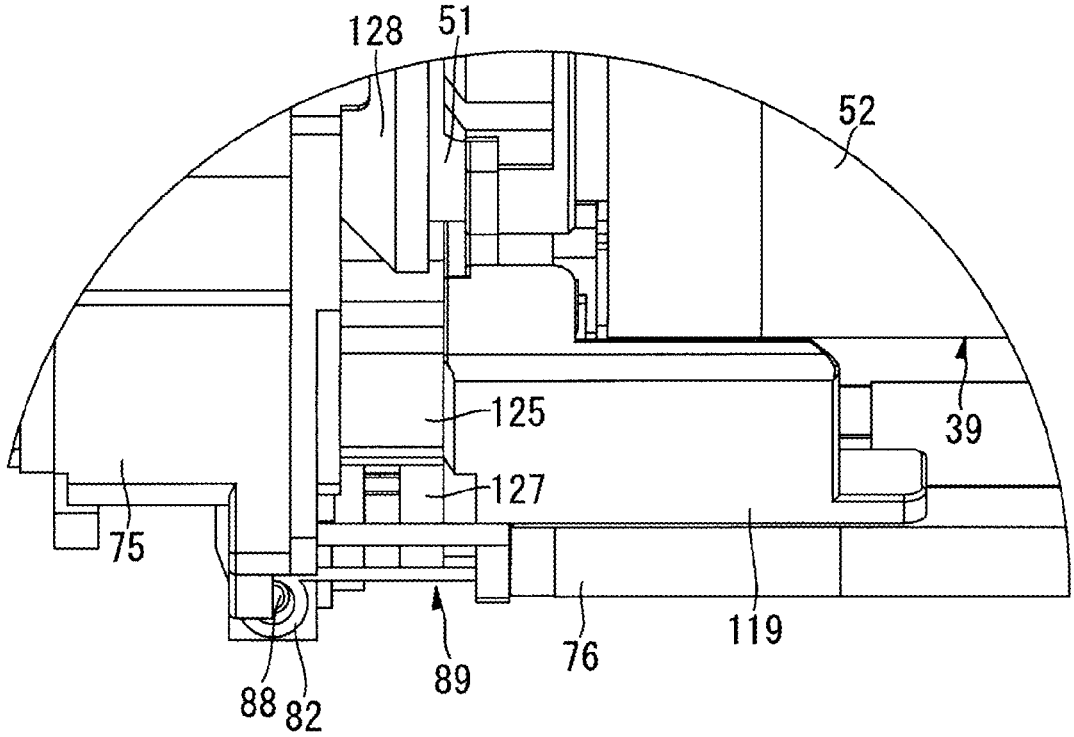
FIG. 12 is a detailed view of the portion enclosed by a chain double-dashed line of FIG. 11.
Figure 13:
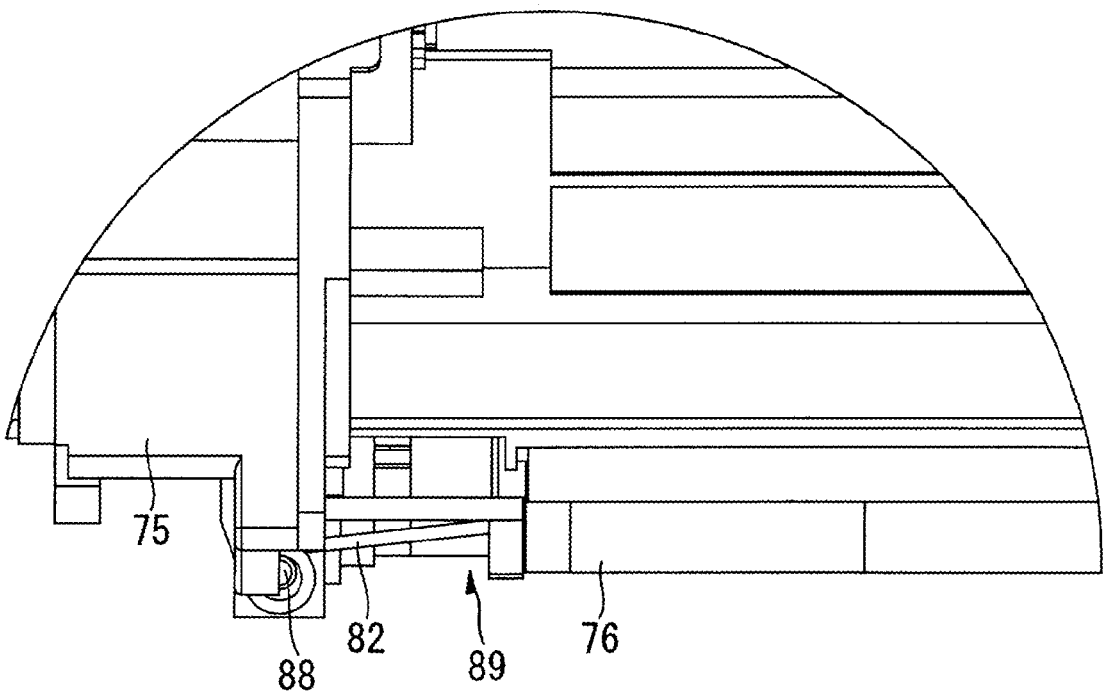
FIG. 13 is a detailed view of a portion corresponding to the portion of FIG. 12 before a developer cartridge is attached.

FIG. 11 is a rear side view (view from the rear) of the drum sub unit 28 attached with the developer cartridge 27, and FIG. 12 is a detailed view of the portion enclosed by a chain double-dashed line of FIG. 11. FIG. 13 is a detailed view of the portion corresponding to the portion of FIG. 12 before the developer cartridge is attached. Note that in FIG. 11 the side frame 75 is shown as the drum sub unit 28, and the components supported by the side frame 75, e.g., the photoconductive drum 29, are not shown.

The developer cartridge 27 is attached to the corresponding drum sub unit 28 substantially along the vertical direction from above the drum unit 26.

To be more specific, for such attachment, the collar member 128 provided at both end portions of the developer roller shaft 51 of the developer cartridge 27 in the axis direction is inserted to the guide groove 77, which is formed to each of the side frames 75 of the corresponding drum sub unit 28. The developer cartridge 27 is then pushed downward in respect to the drum sub unit 28 in such a manner that the collar members 128 at the both end portions of the developer roller shaft 51 in the axis direction slide along the guide groove 77. When the collar members 128 at both end portions of the developer roller shaft 51 in the axial direction abut the deepest portion of the guide groove 77, the developer cartridge 27 is not allowed to go further so that the developer roller 39 comes in contact with the photoconductive drum 29.

Immediately before the collar members 128 abut the deepest portion of the guide groove 77, the electrode member 127 of the developer cartridge 27 enters the space 89, which is formed between the right side frame 75 and the center frame 76 of the drum unit 26. Almost at the same time when the collar members 128 abut the deepest portion of the guide groove 77, the lower end surface of the electrode member 127 in the space 89 abuts the developer electrode 82 disposed in the space 89, and pushes the developer electrode 82 a little downward. This accordingly establishes a connection between the electrode member 127 of the developer cartridge 27 and the developer electrode 82 so that the developer cartridge 27 is attached to the drum sub unit 28.

When the body casing 2 is attached with the drum unit 26 including the developer cartridges 27 for various colors, a connection is established between the contact point of the developer electrode 82 formed at the tip end surface of the developer electrode holding section 86 and the body-side electrode provided inside of the body casing 2. With such a connection, the bias is applied to the developer roller shaft 51 (developer roller 39) from the body-side electrode via the developer electrode 82 and the electrode member 127.

5. Effects

With such a configuration, when the developer cartridge 27 is attached to the drum unit 26 (drum sub unit 28), the developer electrode 82 abuts the lower end surface of the electrode member 127, i.e., the lowermost portion in the direction along which the developer cartridge 27 is attached. This can prevent the electrode member 127 from sliding in contact with the developer electrode 82 in the process that the developer cartridge 27 is attached or removed. This accordingly can prevent friction from being produced between the electrode member 127 and the developer electrode 82, and can protect the electrode member 127 and the developer electrode 82 from deterioration due to abrasion.

Moreover, because the electrode member 127 is provided at the lower end portion of the developer frame 36, the developer electrode 82 can abut the electrode member 127 at the most downward portion without complicating the configuration.

For comparison, considered here is a case of disposing the electrode member 127 at some point on the developer frame 36 in the vertical direction. In this case, to make the electrode member 127 abut the developer electrode 82 at the most downstream portion in the direction along which the developer cartridge 27 is attached, the electrode member 127 has to be protruded toward outside of the developer frame 36 in the width direction. Such a configuration requires the electrode member 127 and the components of the drum unit 26 to be disposed not to be obstacles for attachment of the developer cartridge 27 to the drum unit 26. This can complicate the configuration.

On the other hand, considered now is the configuration that the electrode member 127 is provided at the lower end portion of the developer frame 36. The electrode member 127 is disposed so as to extend downward, i.e., on the downstream side in the direction along which the developer cartridge is attached, the electrode member 127 can abut the developer electrode 82 at the most downward portion without complicating the configuration. What can be better is that when the developer cartridge 27 is attached or removed, the electrode member 127 is prevented from being interfered with by the components in the drum unit 26. This thus allows the developer cartridge 27 to be smoothly attached or removed.

Further, because the developer cartridge 27 is attached in the substantially vertical direction, the weight of the developer cartridge 27 can help to stably maintain the connection between the electrode member 127 and the developer electrode 82 abutting thereto at the most downstream portion.

Still further, because the electrode member 127 is formed as a piece with the bearing member 125, the components can be reduced in number and simplified in configuration compared with the configuration in which the electrode member 127 and the bearing member 125 are separately provided.

Still further, because the electrode member 127 enters the space 89 in which the developer electrode 82 is disposed, the developer cartridge can be positioned with respect to the drum unit 26. Moreover, because the developer electrode 82 comes in contact with the electrode member 127 at the space 87, the contact portion can be protected from bumping other members or being touched by a finger when the developer cartridge 27 is removed from the drum unit 26. This accordingly can prevent the contact portion between the developer electrode 82 and the electrode member 127 from being damaged or getting dirty.

As to the drum unit 26, because the side frame 75 is provided with the developer electrode 82, there is no more need to include a specific member for supporting the developer electrode 82. As such, the developer electrode 82 can be supported to be able to abut the electrode member 127 of the developer cartridge 27.

6. Another Illustrative Developer Cartridge

Figure 14:
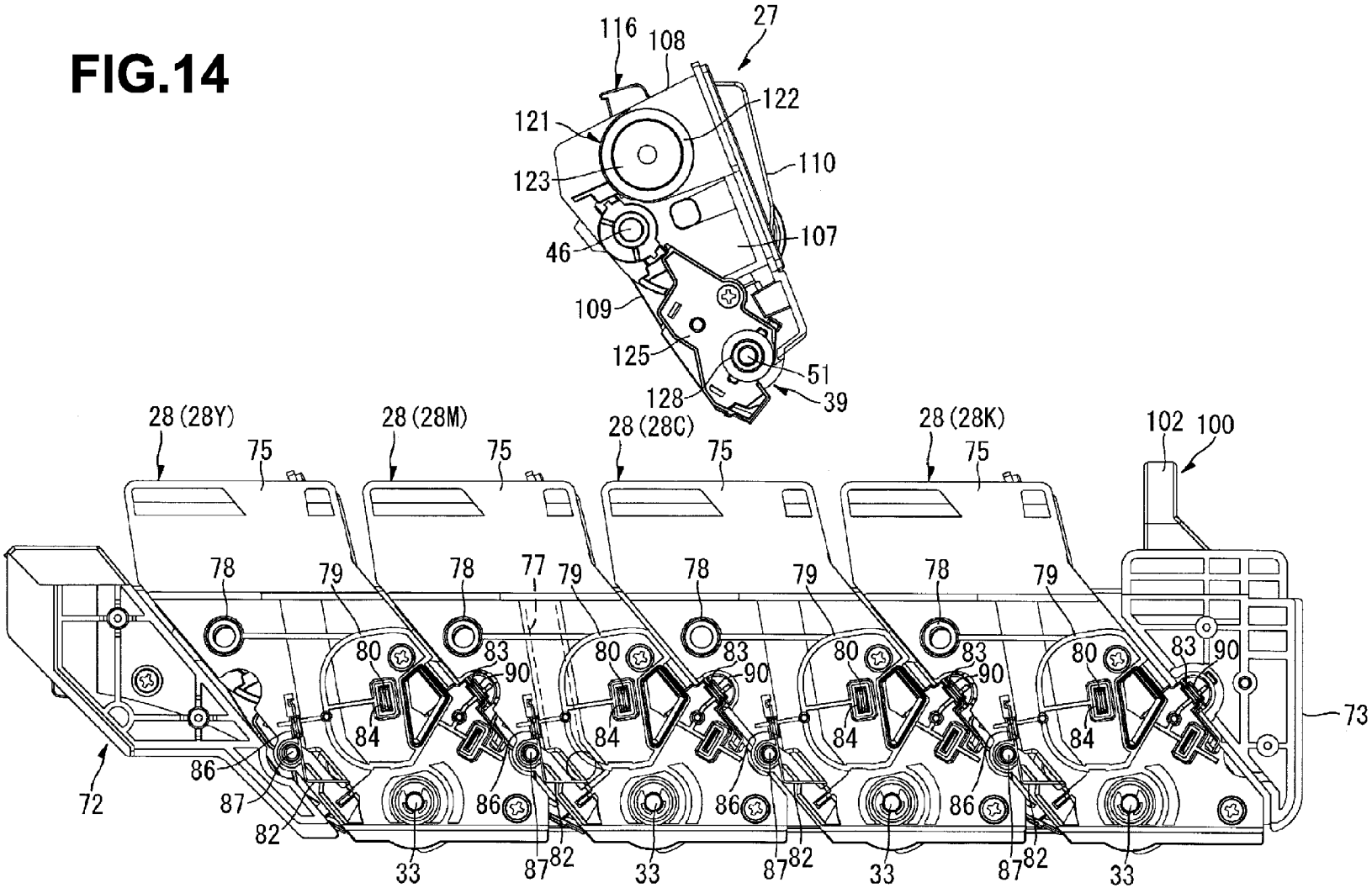
FIG. 14 is a right side view of another illustrative developer cartridge according to aspects of the invention.
Figure 15:
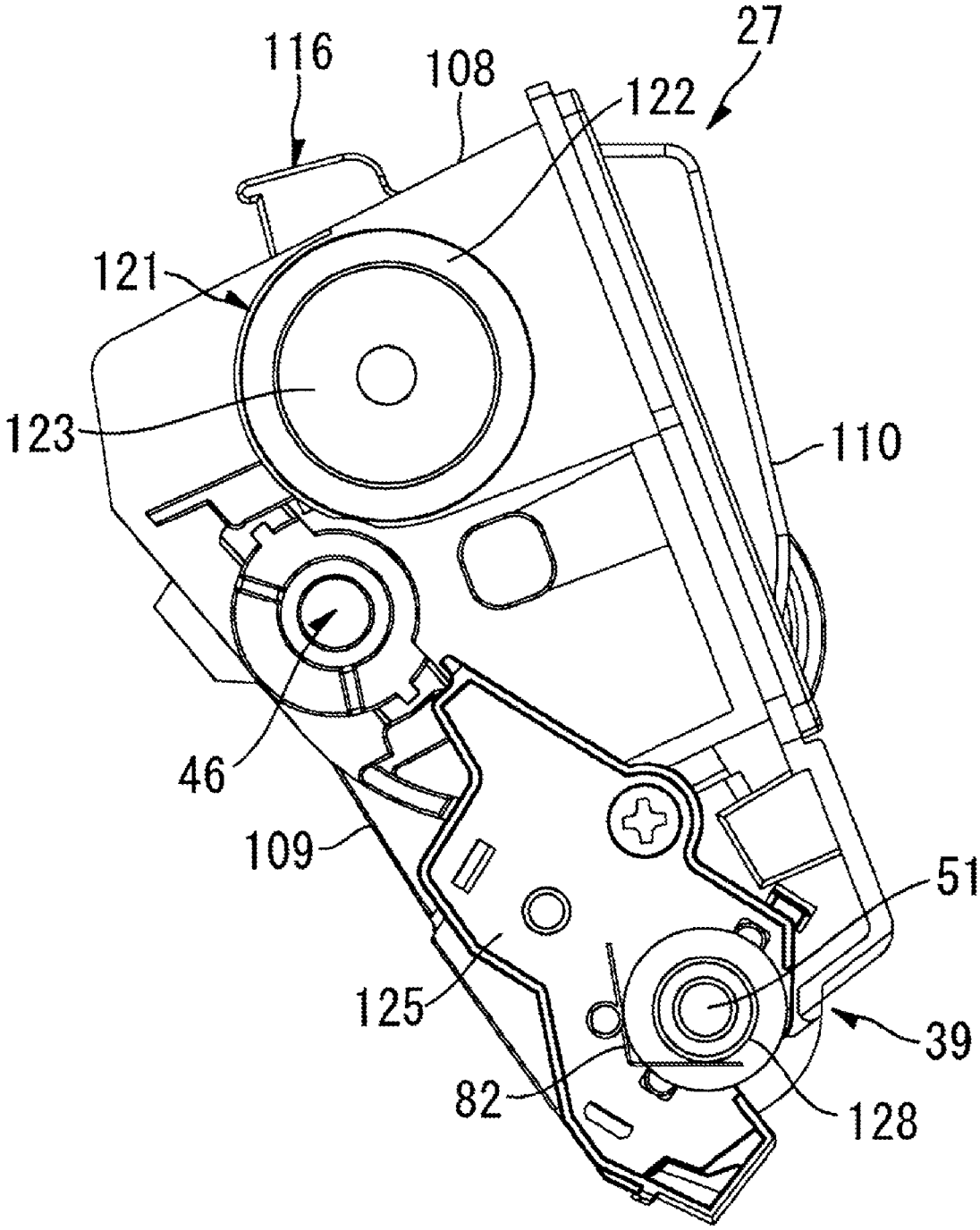
FIG. 15 is a right side view illustrating the connection state of the developer cartridge with a developer electrode of FIG. 14.

FIG. 14 is a right side view of another illustrative developer cartridge 27 according to aspects of the invention. FIG. 15 is a right side view illustrating the connection state with the developer electrode 82 of the developer cartridge 27. In FIGS. 14 and 15, any component similar to the components described above is provided with the same reference numeral, and is not described again. Note that FIG. 14 shows the developer cartridge 27, and the drum unit 26 from which the side plate 74 is removed.

The developer cartridge 27 in these aspects includes no electrode member 127, and the collar member 128 covering, from outside, the right-side shaft end portion of the developer roller shaft 51 serves as the electrode member.

The collar member 128 is made of a conductive material, and abuts the developer electrode 82 provided to the drum unit 26 when the developer cartridge 27 is attached to the drum unit 26.

The developer electrode 82 is routed to the developer electrode holding section 86, and extends downward from the developer electrode holding section 86. After forming a loop along the circumferential surface of the first latch boss 87, the developer electrode 82 extends a little downward, and then is bent toward the rear. The tip end portion of the developer electrode 82 is disposed at the position corresponding to the position of the collar member 128 inside of the right side frame 75 in the width direction in the state that the developer cartridge 27 is attached to the drum unit 26.

The bearing member 125 is made of a non-conductive resin.

When the developer cartridge 27 is attached to the drum sub unit 28 substantially along the vertical direction from above the drum unit 26, immediately before the collar member 128 abuts the deepest portion of the guide groove 77, the collar member 128 at the right-side shaft end portion of the developer roller shaft 51 abuts the tip end portion of the developer electrode 82, which is disposed inside of the right side frame 75 in the width direction. The collar member 128 accordingly pushes the developer electrode 82 a little downward. This accordingly establishes a connection between the collar member 128 on the side of the developer cartridge 27 and the developer electrode 82.

Such a configuration also can achieve the effects similar to the configuration of the developer cartridge 27 of FIG. 10. Because the collar member 128 serves also as an electrode member, the components can be reduced in number, bias can be applied to the developer roller 39, and the shaft end portion of the developer roller shaft 51 can be protected.

7. Another Illustrative Developer Electrode

Figure 16:
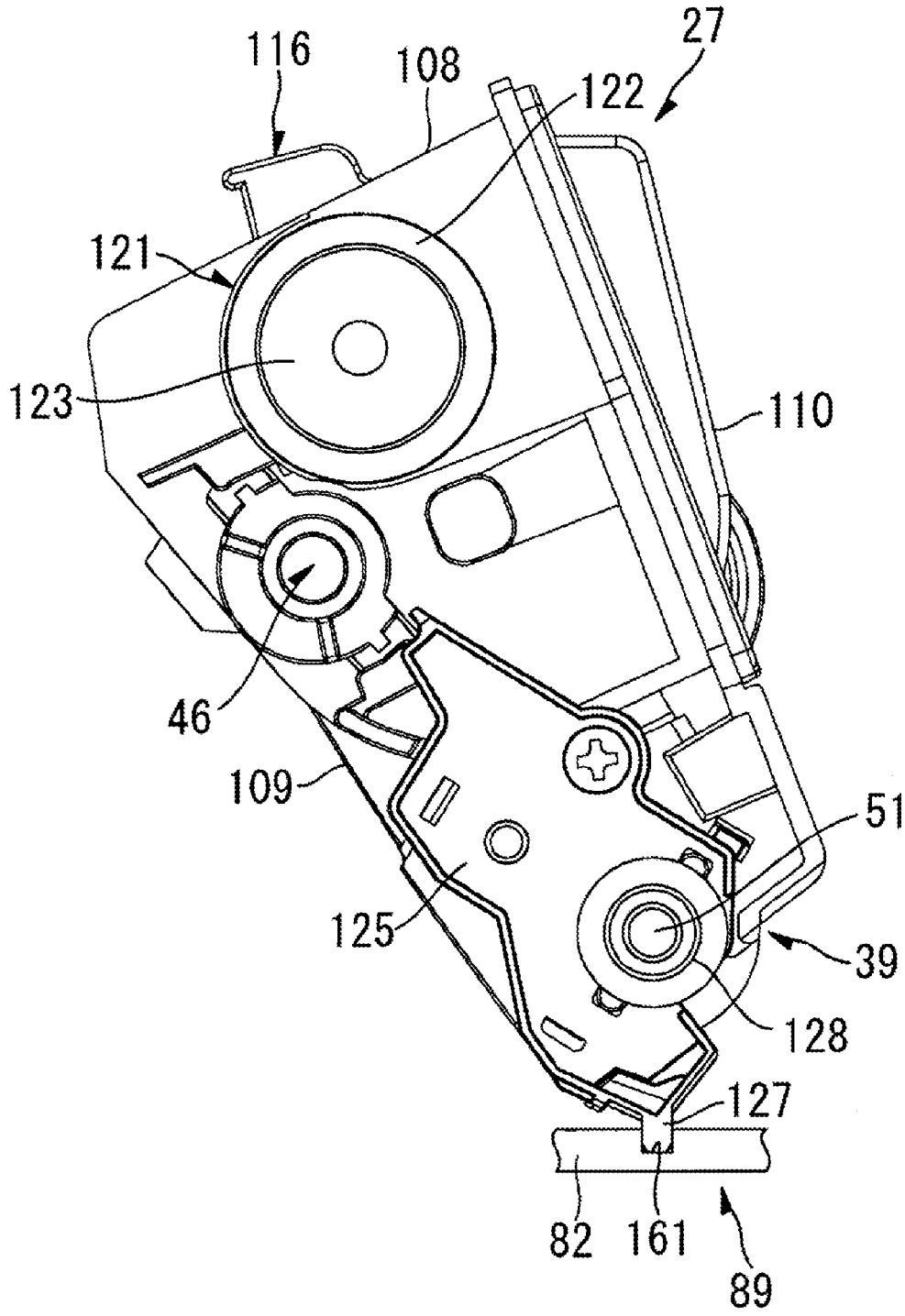
FIG. 16 is a right side view of another illustrative developer electrode according to aspects of the invention.

FIG. 16 is a right side view of another illustrative developer electrode 82 according to aspects of the invention. In FIG. 16, any component similar to the components described above is provided with the same reference numeral, and is not described again.

As shown in FIG. 16, the developer electrode 82 is disposed in the space 89 formed between the right side frame 75 and the center frame 76 of the drum unit 26. The developer electrode 82 is formed with a concave section 161 that can be coupled with the electrode member 127, which protrudes downward from the lowermost end portion of the bearing member 125. As such, the electrode member 127 may be connected to the developer electrode 82 through convex-concave coupling. With this being the case, while stably maintaining the connection between the electrode member 127 and the developer electrode 82, the developer cartridge 27 can be positioned with respect to the drum unit 26.

Note that the developer electrode 82 can establish an electronic connection between the contact point of the developer electrode 82 with the body-side electrode and any portion formed with the concave section 161 by forming the portion formed with the concave section 161 using a conductive resin, and connecting a wire routed to the developer electrode holding section 86 (refer to FIG. 4) to the portion.

8. Modified Example

In the above-described aspects, exemplified is the drum unit 26 being removably attached to the body casing 2, and the configuration in which the drum unit 26 is removably attached with the developer cartridges 27 for various colors. Alternatively, the drum unit 26 may be fixed to the body casing 2, an upper surface cover may be provided to open/close the upper surface of the body casing 2, and the developer cartridges 27 may be directly attached/removed to/from the body casing 2. If this is the case, the configuration may not be provided with the front beam 72, the rear beam 73, and the pair of side plates 74, and the drum sub units 28 may be attached to the side surface of the body casing 2. That is, the drum unit 26 may not be provided, and the drum sub units 28 may be fixed inside of the body casing 2. Also, developer electrode 82 may be disposed at the body casing 2.

What is claimed is:

1. A developer cartridge, comprising:

a developer roller;

a casing rotatably supporting the developer roller so that the developer roller is exposed to outside, the casing including a developer wall that supports the developer roller at both end portions of the developer roller in an axial direction; and an electrode member electrically connected to the developer roller, wherein the electrode member is provided to extend from a farthest most portion of the developer wall toward a direction to which the developer roller is exposed.

2. The developer cartridge according to claim 1, wherein the casing includes an opening exposing the developer roller, and the electrode member is disposed at an edge of the opening.

3. A developer cartridge attachable to and detachable from an image forming unit, the developer cartridge comprising:

a developer roller;

an electrode member electrically connected to the developer roller and configured to contact a power supply member disposed at the image forming unit; and a casing supporting the developer roller, wherein the electrode member is provided at a downstream end of the casing in an attachment direction along which the developer cartridge is attached to the image forming unit, wherein the casing includes a developer wall that supports the developer roller at both end portions of the developer roller in an axial direction, and the electrode member is provided to extend from a farthest most portion of the developer wall in the attachment direction.

4. The developer cartridge according to claim 3 further comprising a bearing member for accepting a shaft end portion of the developer roller, wherein the electrode member is provided at the bearing member.

5. The developer cartridge according to claim 3 further comprising a protection member that is attached to a shaft end portion of the developer roller, wherein the electrode member is provided at the protection member.

6. The developer cartridge according to claim 3, wherein the developer cartridge is attached to and detached from the image forming unit substantially along a vertical direction.

7. The developer cartridge according to claim 3, wherein the electrode member is convex-shaped and configured to engage with the power supply member which is concave-shaped.

8. The developer cartridge according to claim 3, wherein the electrode member is convex-shape and is configured to enter a space in which the power supply member is disposed.

9. The developer cartridge according to claim 3, wherein the electrode member is formed with a rectangular plate shape.

10. The developer cartridge according to claim 3, wherein the developer cartridge is attachable to and detachable from the image forming unit which is a drum unit that includes at least one photosensitive drum.

11. A process unit attached to and detached from an image formation device, comprising:

a drum unit supporting at least one photosensitive drum, the drum unit including a power supply member, a developer cartridge attached to and detached from the drum unit, the developer cartridge, including a developer roller configured to supply developer to the photosensitive drum; and an electrode member electrically connected to the developer roller, the electrode member configured to be provided a bias from the power supply member; and a casing supporting the developer roller, the casing including a developer wall that supports the developer roller at both end portions of the developer roller in an axial direction, wherein the electrode member is provided at a downstream end of the casing in an attachment direction along which the developer cartridge is attached to the drum unit, and is configured to contact the power supply member, and wherein the electrode member extends from a farthest most portion of the developer wall in the attachment direction.

12. The process unit according to claim 11, wherein the drum unit includes a unit wall that supports both end portions of the at least one photosensitive drum in an axial direction, and the power supply member is provided to the unit wall.

13. An image formation device, comprising:

a body, at least one photosensitive drum supported at the body, a power supply member, a developer cartridge attached to and detached from the body, the developer cartridge, including a developer roller supplying a developer to the photosensitive drum;

an electrode member electrically connected to the developer roller, the electrode member configured to be provided a bias from the power supply member; and a casing supporting the developer roller, the casing including a developer wall that supports the developer roller at both end portions of the developer roller in an axial direction, wherein the electrode member is provided at a downstream end of the casing in an attachment direction along which the developer cartridge is attached to the body, and is configured to contact the power supply member disposed at the body, and wherein the electrode member extends from a farthest most portion of the developer wall in the attachment direction.

* * * * *